US005226743A

United States Patent [19]

Jackson et al.

[11] Patent Number: 5,226,743

[45] Date of Patent: Jul. 13, 1993

[54] METHOD AND APPARATUS FOR PAPER CONTROL IN A PRINTER

[75] Inventors: Larry A. Jackson; Kieran B. Kelly, both of Vancouver, Wash.

[73] Assignee: Hewlett-Packard Company, Palo Alto, Calif.

[21] Appl. No.: 686,214

[22] Filed: Apr. 16, 1991

[51] Int. Cl.[5] ..... B41J 11/58

[52] U.S. Cl. ..... 400/625; 400/185; 400/58; 400/629

[58] Field of Search ..... 400/58, 185, 600.1, 400/600.2, 600.4, 579, 625, 630, 645.3, 656, 626, 629, 641

[56] References Cited

U.S. PATENT DOCUMENTS

| | | | |
|---|---|---|---|
| 2,366,206 | 1/1945 | Metzner | 400/625 |
| 4,438,915 | 3/1984 | Akamatsu et al. | 271/9 |
| 4,509,734 | 4/1985 | Rutishauser | 400/625 X |
| 4,581,618 | 4/1986 | Watanabe et al. | 400/185 X |
| 4,721,297 | 1/1988 | Katayama | 400/625 X |
| 5,062,726 | 11/1991 | Inomata et al. | 400/579 X |

FOREIGN PATENT DOCUMENTS

| | | | |
|---|---|---|---|
| 0228789 | 7/1987 | European Pat. Off. . | |
| 0310422 | 4/1989 | European Pat. Off. . | |
| 0312407 | 4/1989 | European Pat. Off. . | |
| 0139474 | 7/1985 | Japan | 400/185 |
| 0121972 | 6/1986 | Japan | 400/656 |

OTHER PUBLICATIONS

IBM Technical Disclosure Bulletin, vol. 30 No. 12 May 1988, "Bill Stacker for Bill-Handling Machine".

Research Disclosure, Jul. 1990, No. 315 "Skew Correction Technique".

*Primary Examiner*—Edgar S. Burr

*Assistant Examiner*—Christopher A. Bennett

[57] ABSTRACT

An apparatus for control of a sheet of paper in a printer mechanism includes a single motor drive mechanism, a frame, a platen, a roller assembly for advancing the sheet of paper over the platen, and a kicker element for selectively contacting only an edge of a sheet of paper and for urging the sheet of paper in a forward direction once it is forwardly disengaged from the roller assembly.

19 Claims, 14 Drawing Sheets

METHOD AND APPARATUS FOR PAPER CONTROL IN A PRINTER

FIELD OF THE INVENTION

This invention relates generally to printers, and more particularly to a method and apparatus for active skew correction and control of paper in a cut-sheet printer mechanism.

BACKGROUND OF THE INVENTION

In automatic cut-sheet printers, a stack of paper, cut to uniformly sized sheets, is automatically fed to a printer, typically using a roller assembly or other mechanisms. An important function of the printer feed mechanism is to control the parallelism between the top edge of the sheet of paper and the first line of print contained thereon, i.e., the amount of skew between the paper and the print. Even a small amount of skew between the paper and the print will cause the printing to appear crooked. Larger amounts of skew may cause buckling of the paper, resulting in uneven print quality or jamming of the paper within the printer. The skew is generally induced when the paper is loaded into and/or picked from a stack of paper in a supply tray. Accordingly, it is desirable to minimize the amount of skew between the paper and the printing assembly once the paper has been picked and before it is printed on.

Prior art printing devices use a variety of techniques and apparatus to minimize skew. Some printers minimize skew by forcing a sheet of paper into a pair of stalled rollers, creating a buckle in the paper and forcing the leading edge of the paper to be parallel with the roller pair. The rollers are then activated to advance the paper into the print zone. Such a technique requires some type of clutching mechanism to stall the rollers long enough to allow the paper to be fed into the nip between the rollers. Further, this technique requires accurate control of the paper while it is buckling, as the buckle must be large enough to correct the skew, yet small enough that the paper does not flip out of the nip between the stalled rollers. Other prior art printers use tapered rollers which direct the sheet of paper against a reference wall, forcing it into alignment therewith and eliminating any skew before printing. This technique requires a large, flat surface in the area of the roller assembly and is relatively slow. Still other printers have no skew correction mechanism at all, relying entirely on the accurate feeding of paper into the roller assembly.

In addition to minimizing skew, the feed mechanism of a printer must maintain accurate control of each sheet, from the time it is picked from the stack until it is ejected from the printer. The paper feed mechanisms of typical prior art printers use separate motors and gear arrangements to pick the paper from a stack, deliver the paper to the printing assembly, line feed the paper and eject the paper once printed. Such feed mechanisms often encumber the carriage drive motor and have complex timing schemes requiring triggering devices, such as solenoids. The large number of motors and other electrical components increases the cost of the printer. Further, complex feed mechanisms increase the amount of time necessary to pass a page through the printer, as well as the chances of paper jams and skew errors.

Accordingly, it is desirable to control the feed of paper through a printer using a minimum number of control devices so as to reduce the cost of the printer and increase the printer reliability and throughput.

It is, therefore, an object of the present invention to provide a paper control apparatus in a printer which has relatively few components and particularly few active components, such as motors and solenoids.

It is a further object of the present invention to provide a paper control apparatus in a printer which minimizes the possibility of catching and paper jams.

It is another object of the present invention to provide a paper control apparatus in a printer which may be driven by a single motor.

It is another object of the present invention to provide a paper control apparatus in a printer which may be implemented economically.

It is a further object of the present invention to provide a paper control apparatus in a printer which increases the throughput of the printer.

It is yet a further object of the present invention to provide a method for controlling the parallelism between the top edge of a sheet of paper and the print contained thereon.

It is a further object of the present invention to provide an active skew correction apparatus which operates quickly.

It is yet another object of the present invention to provide an active skew correction apparatus which does not require special timing or active triggering mechanisms, such as motors or solenoids.

It is yet a further object of the present invention to provide an active skew correction apparatus which may be implemented economically.

SUMMARY OF THE INVENTION

The above and other objects are achieved in accordance with the present invention which, according to a first aspect of the invention. provides a skew correction apparatus and method for controlling the parallelism between the top edge of a sheet of paper and the print contained thereon. The method of skew correction includes the steps of advancing a sheet of paper, disposed at an acute angle of approximately 60° with respect to horizontal, into the nip formed between a drive roller and a pinch roller, wherein the nip is defined as the region where the rollers are touching. The leading edge of the paper is advanced slightly beyond the nip. The rotational direction of the rollers is reversed, causing the paper to move backwardly until both sides disengage from the roller assembly. Upon disengagement, the angle and weight of the paper encourage its leading edge to settle in the nip, and as a result, to be parallel to the nip. While the rollers continue to rotate in reverse, the paper is allowed to jiggle, or "gravity dance" so that the leading edge of the paper is further encouraged to settle parallel with the nip of the roller assembly under its own weight. The rollers are stopped and again reversed, causing the paper to advance through the roller assembly, with its leading edge parallel to the nip. The paper advances a predetermined distance into the print zone before ink is deposited thereon to ensure a uniform top margin or "top-of-form" on each sheet.

The method of skew correction of the present invention is achieved with an apparatus which includes a single drive motor, and a microprocessor, coupled to the drive motor for selectively controlling the angular velocity of the drive motor. A pick roller and a drive roller assembly, including a drive roller and a pinch roller disposed adjacent to one another so as to form a nip therebetween, are coupled to the drive motor by a plurality of gears. The preprogrammed microprocessor controls the drive motor which, via the gears, selectively rotates the pick roller and drive roller assembly, causing advancement and retraction of the leading edge of a sheet of paper through the nip of the drive roller assembly to achieve the skew correction method of the present invention.

A second, equally important aspect of the present invention is apparatus for single motor control of a sheet of paper in a printer. This apparatus reflects the preferred embodiment of the skew correction apparatus of this invention, although other types of apparatus may be used to implement the skew correction of this invention. This apparatus comprises a roller assembly having a drive roller and a pinch roller disposed parallel with and adjacent to one another so as to form a nip therebetween; means for supplying a sheet of paper to the roller assembly; a platen; a printing assembly for depositing ink on the sheet of paper; means for receiving the sheet of paper from the platen and the printing assembly; a drive motor; and means for coupling the drive motor to the drive roller assembly, the platen, and the supply means, and for controlled movement of the sheet of paper from the supply means through the printing assembly to the receiving means. In one embodiment, the control means comprises a programmable digital processor and the coupling means comprises a plurality of gears, rotatably intercoupled, for coupling the drive motor with the roller assembly, the platen and the supply means. In this manner, a single drive motor, through a plurality of gears and cams, controls the timing, speed and rotational direction of the roller assemblies and platen, from the initial feed of the paper through the printing process.

BRIEF DESCRIPTION OF THE DRAWINGS

The objects, advantages and features of this invention will be more clearly appreciated from the following detailed description taken in conjunction with the accompanying drawings in which.

DETAILED DESCRIPTION OF THE PREFERRED EMBODIMENTS

Figure 1:
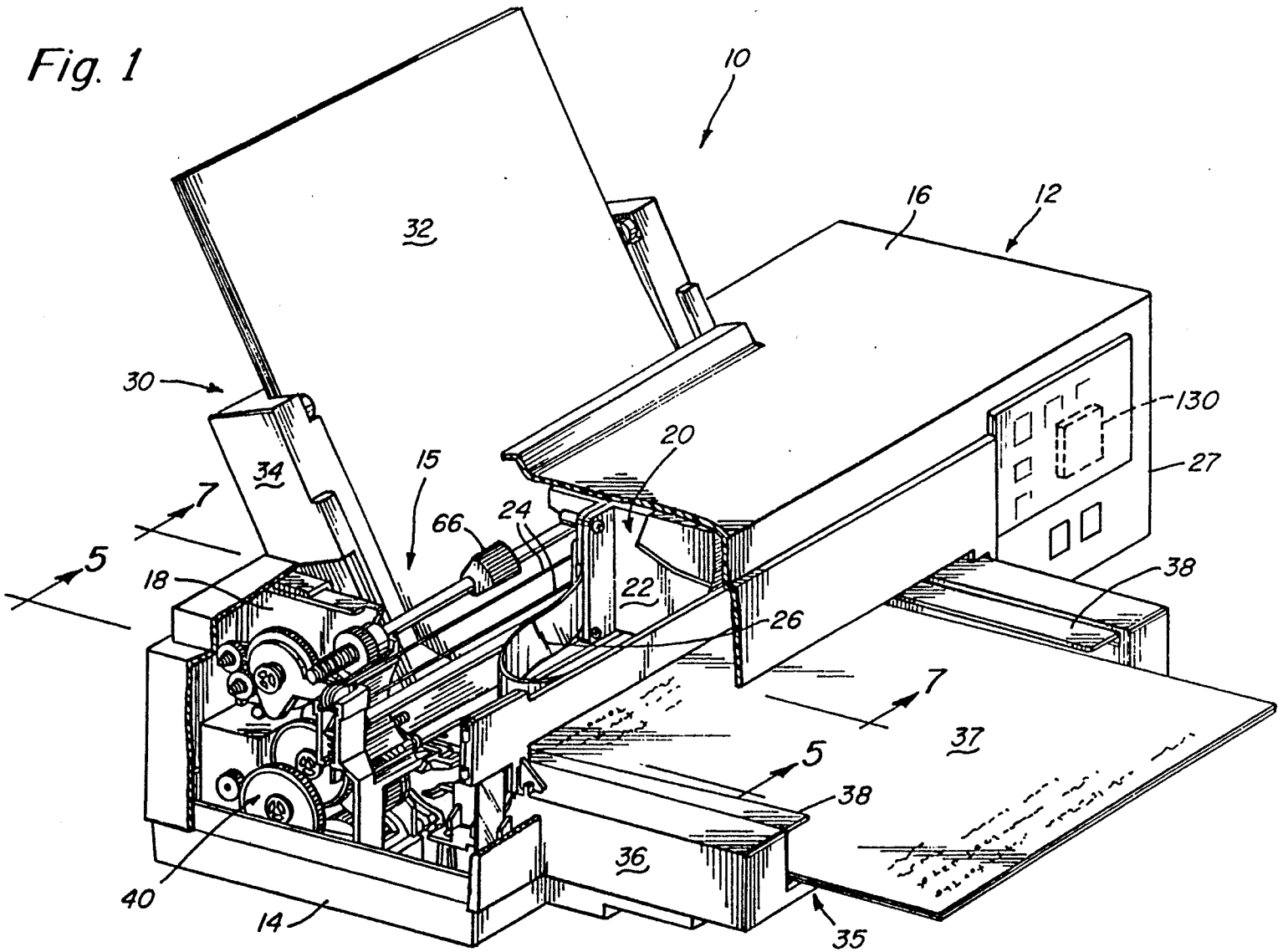
FIG. 1 is a perspective view of a printer containing the paper control and skew correction apparatus of the present invention.

With reference now to the drawings, and more particularly to FIG. 1 thereof, a typical printer will be described with which the paper control and skew correction apparatus of this invention may be used. Printer 10, as shown in the drawings, is of the ink-jet type in which printing is done in a substantially horizontal plane. However, it is to be understood that paper control and skew correction apparatus of this invention is shown used in conjunction with this type of printer for purposes of illustration only. The apparatus of this invention may be used with other types of printers including impact printers, and the like, as well as printers in which the printing is not done in a substantially horizontal plane and which have different configurations.

As shown in FIG. 1, printer 10 includes a housing assembly 12 which contains paper control apparatus 15 and printing assembly 20. Housing assembly 12 is comprised of a substantially rectangular base 14 having a pair of frame walls 18 projecting upwardly therefrom. A support 13 (shown in FIG. 7), having a substantially L-shaped cross-sectional profile and a lip, extends between frame walls 18 and is disposed at an angle for supporting supply assembly 30 as explained hereinafter. The components of paper control apparatus 15 and printing assembly 20 are secured to base 14, walls 18 and support 13, as explained hereinafter. A cover 16 is removably mounted to base 14, to allow access to the interior thereof. A supply tray 34 containing a paper supply 32, or other print medium, is removably mounted within an aperture on top of cover 16 for supplying paper to printer 10. A receiving tray 36 which is secured to base 14, projects outwardly from an aperture in front of cover 16, for receiving printed sheets of paper. Each sheet of paper is moved by paper control apparatus 15 through a printing zone where print assembly 20 deposits ink on it as it advances toward receiving tray 36.

Figure 4:
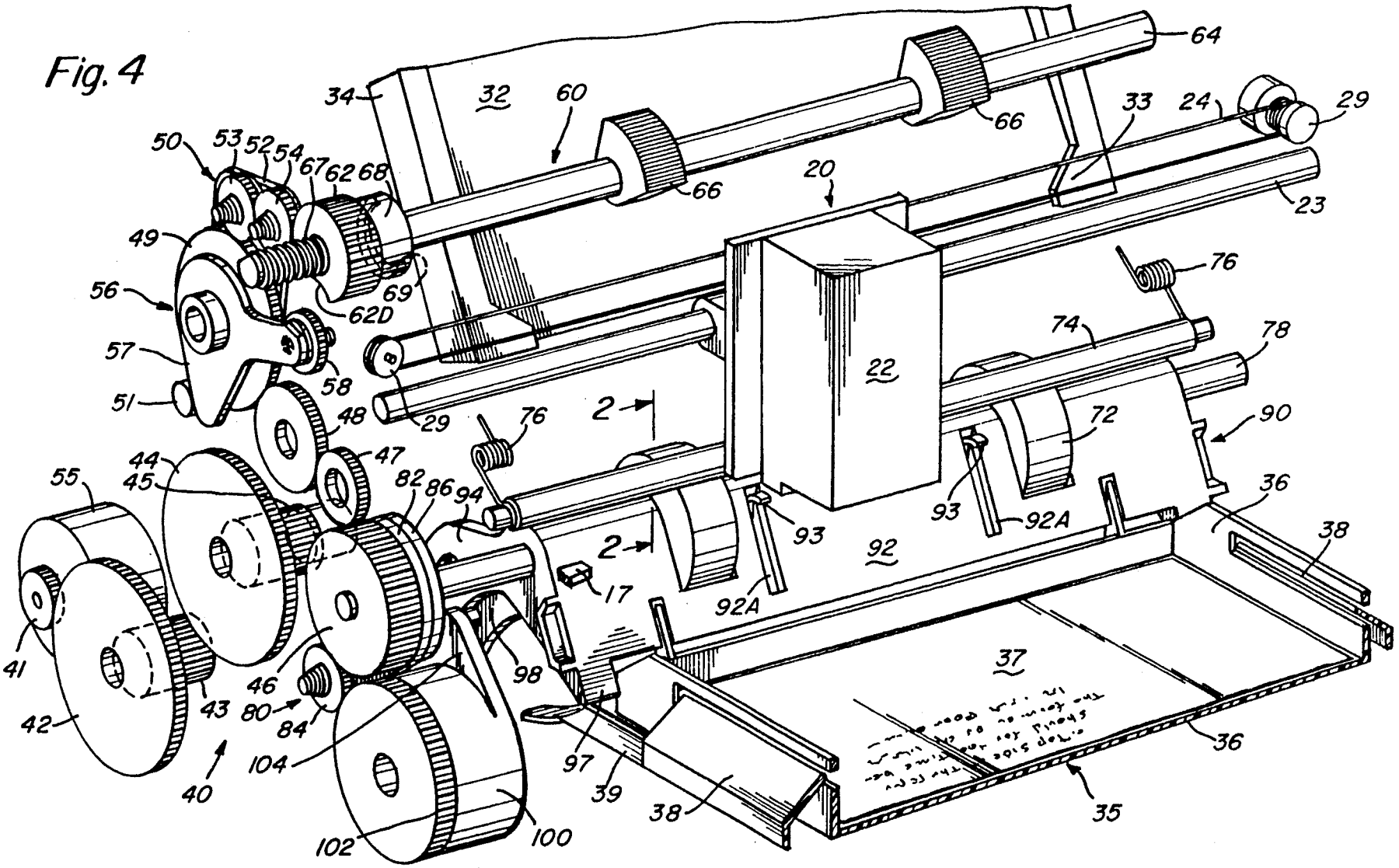
FIG. 4 is an exploded, perspective view of the paper control and skew correction apparatus of FIG. 1.
Figure 7:
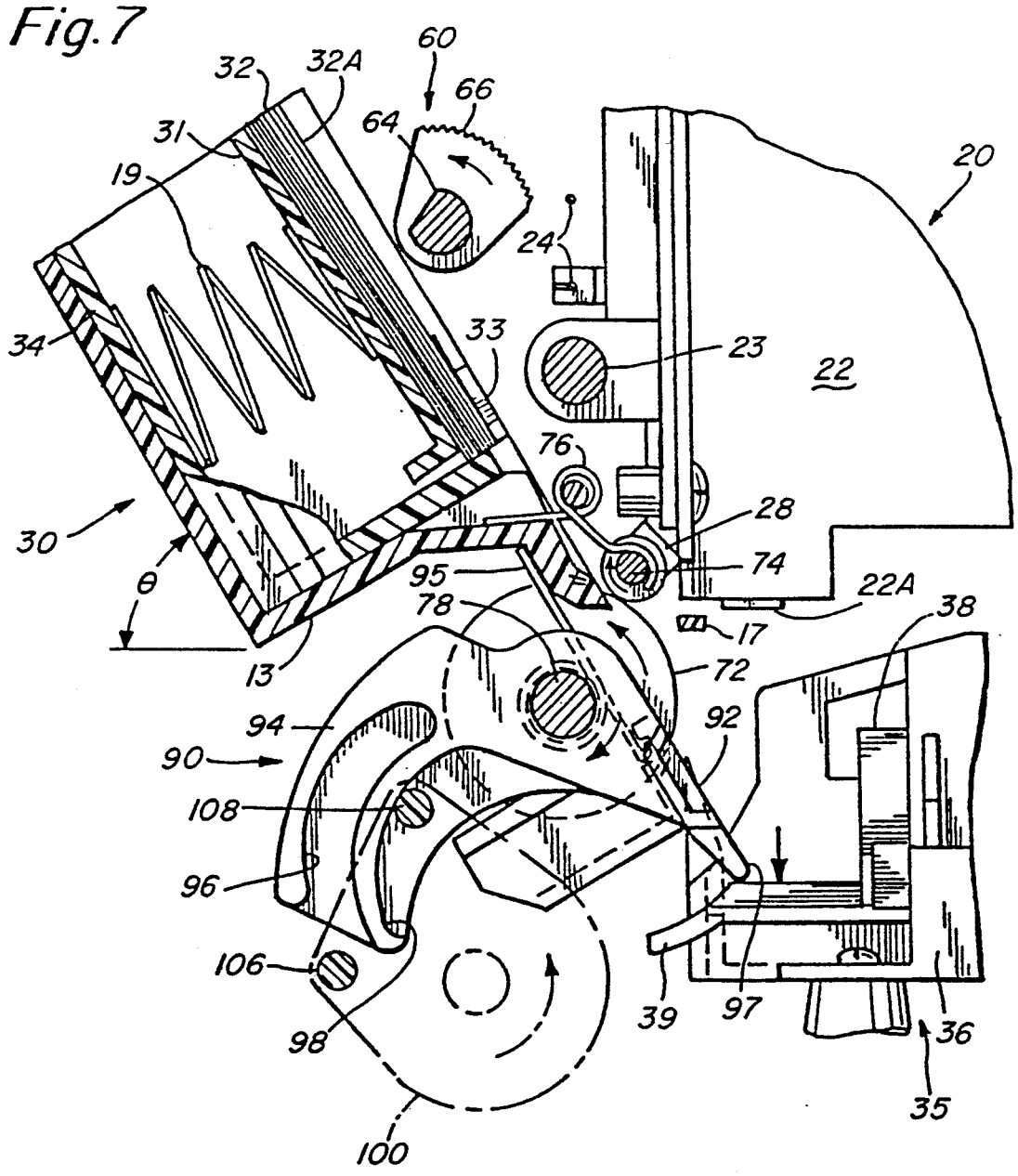
FIG. 7 is a partial, side cut-away view of the paper control and skew correction apparatus of FIG. 1 as seen along line 7—7.

Referring to FIGS. 1, 4 and 7, print assembly 20 includes print head carriage 22 which travels back and forth on carriage rod 23 through the printing zone. Print head carriage 22 moves bidirectionally by means of a drive wire 24 coupled to a carriage motor by drive wire spools 29, in a manner well known to those skilled in the art. The bottom of the printhead carriage includes a low friction pad 28 which rests on pinch roller 74 allowing printhead carriage 22 to slide easily thereover. Print head carriage 22 includes one or more print cartridges (not shown) having print heads 22A contained at the bottom thereof. The print head cartridges are connected by a flexible electrical interconnect strip 26 to a microprocessor 130, shown in phantom in FIG. 1, which also controls the carriage motor. A control panel 27 is electrically coupled with the microprocessor 130 for selection of various options relating to the operation of print assembly 20. Such control operations, provided by presently available microprocessors, are well known in the prior art. The structure and operation of print assembly 20 forms no part of this invention, and accordingly will not be described in further detail hereinafter. Further, although microprocessor 130 is shown in the proximity of control panel 27 in FIG. 1, it will be obvious to those reasonably skilled in the art that microprocessor 130 may be positioned at other locations within housing 12, provided that the necessary electrical connections may be made to the other elements of printer 10.

Figure 2:
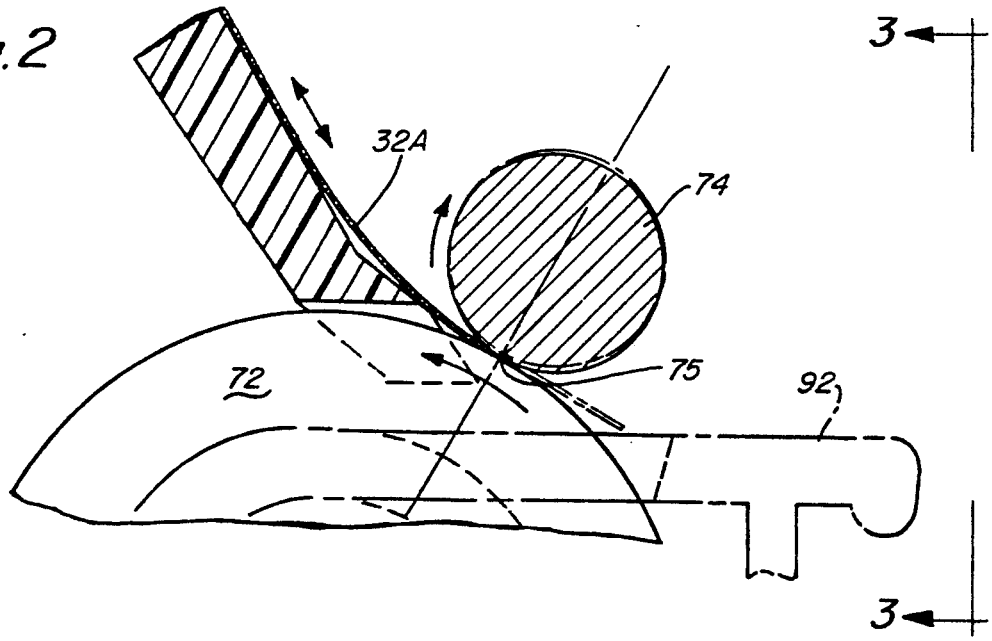
FIG. 2 is an enlarged, partial side view of the paper control and skew correction apparatus as seen along line 2—2 of FIG. 4.
Figure 3:
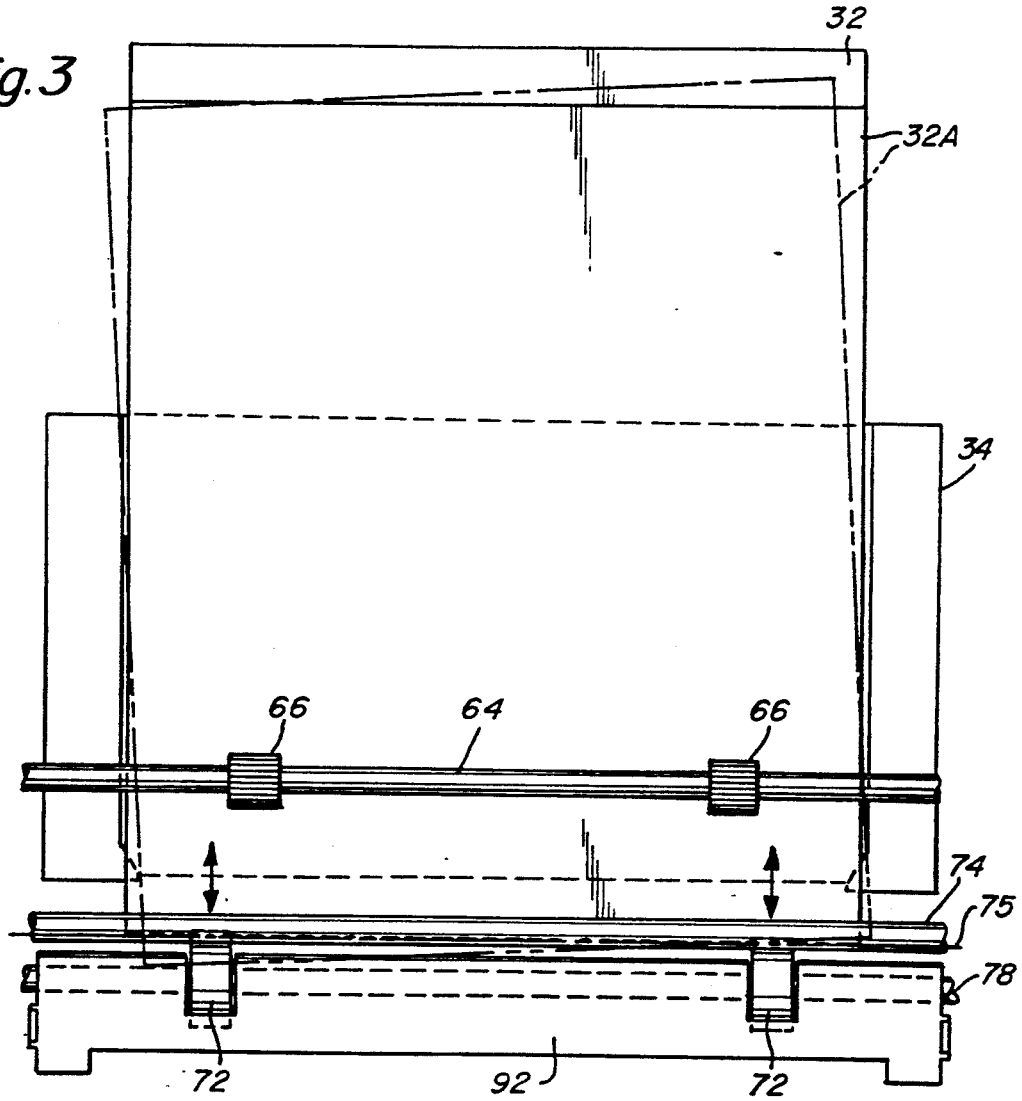
FIG. 3 is a partial front view of the paper control and skew correction apparatus of FIG. 2, as seen along line 3—3.

Referring to FIGS. 2 and 3, a top sheet of paper 32A from paper supply 32 is picked by pick rollers 66 and advanced to the drive rollers 72 which advance the paper into the printing zone of printer 10 by a roller assembly 70 which partially comprises a pair of annular drive rollers 72, mounted about a drive roller axle 78, and a pinch roller 74 in frictional, rotational engagement with drive rollers 72. As drive roller axle 78 rotates drive rollers 72 in one direction, pinch roller 74 is rotated in a counter-angular direction. A nip 75, indicated by lines in FIGS. 2 and 3, is formed between the drive roller 72 and pinch roller 74 where the rollers make frictional contact. The combined rotational motion of drive rollers 72 and pinch roller 74 facilitates advancing or retracting sheet 32A through nip 75, depending on the directions of rotation of the roller pair, as explained hereinafter.

According to a first aspect of the present invention, an active skew correction apparatus and method for controlling the parallelism between the top edge of a sheet of paper 32A and the print contained thereon are described as follows. Generally, the method of skew correction of the present invention, comprises the steps of advancing a sheet of paper, disposed at an acute angle of preferably 60° from horizontal, into nip 75 formed between a drive rollers 72 and a pinch roller 74. The leading edge of the sheet 32A is advanced slightly beyond nip 75 by the roller assembly 70. The direction of rollers 72 and 74 is then reversed, causing the sheet 32A to move backwards and disengage from both sides of the rollers 72 and 74. Pick rollers 66 do not touch sheet 32A during its backwards movement. The weight of the paper encourages its leading edge to settle within nip 75. The sheet 32A jiggles or does a "gravity dance", while rollers 72 and 74 continue to run in a reverse direction, further encouraging sheet 32A to settle into nip 75 so that its leading edge is parallel with the nip. Rollers 72 and 74 are again reversed causing sheet 32A to advance through nip 75 with its leading edge parallel to the roller pair and the horizontal printing zone. A uniform "top-of-form" location may be located on each sheet by simply advancing the leading edge a predetermined distance beyond the nip, without the need for special detection switches, as in prior art printers. For the purposes of this disclosure, the horizontal printing zone, and consequently the resulting lines of print, are assumed to be parallel with nip 75. In this manner, if the leading edge of sheet 32A is parallel with nip 75, it will also be parallel with the first and all subsequent lines of print deposited on sheet 32A. The skew correction method of the present invention is achieved with paper control apparatus 15, the operation of which will now be described with reference to FIGS. 2–14.

FIGS. 2 and 3 illustrate side and front views, respectively, of pinch roller 74 and driver roller 72 in relation to top sheet 32A during the gravity dance routine of the present invention. FIG. 2 is an enlarged cross sectional view of rollers 72 and 74 and sheet 32A seen along line 2—2 of FIG. 4. The initial position to which the leading edge of sheet 32A is advanced beyond nip 75 of rollers 72 and 74 is indicated in phantom. Drive roller 72 then rotates counterclockwise while pinch roller 74 rotates clockwise allowing sheet 32A to move backward from its initial position until it disengages from the rollers (all directions are as shown in FIG. 2). As rollers 72 and 74 continue to rotate in reverse, the leading edge of sheet 32A completely disengages from both sides of rollers 72 and 74, and jiggles or dances, settling into nip 75 due to its own weight.

As indicated in FIG. 3, a possible initial skewed position of top sheet 32A during its feed is indicated in phantom. Following the gravity dance, top sheet 32A, assumes the position indicated by the solid lines in FIG. 3, in which its leading edge is shown substantially parallel with nip 75 formed between drive roller 72 and pinch roller 74. With the leading edge of top sheet 32A now parallel with nip 75, the sheet may again be advanced through the nip and into the printing zone.

A preferred embodiment of the single drive motor apparatus of this invention will now be described with particular reference to FIGS. 4–15. This particular embodiment also incorporates the skew correction method and apparatus of this invention and in fact represents the preferred embodiment of the skew correction apparatus. However, it is to be understood that the skew correction method may be implemented with more conventional apparatus using more than one drive motor or for other types of printers. Furthermore, it is to be understood that the method and apparatus using a single motor for control of a sheet of paper during the feed and printing stages need not employ the skew correction method. Microprocessor 130 may be programmed to either include or omit the skew correction feature, as desired.

Paper control apparatus 15 comprises supply assembly 30, receiving assembly 35, transmission assembly 40, first arm assembly 50, second arm assembly 56, pick assembly 60, roller assembly 70, third arm assembly 80, and platen assembly 90. These assemblies interact to provide accurate control and skew correction of paper as it passes through printer 10.

As shown in FIG. 7 supply assembly 30 comprises paper supply 32, supply tray 34, retainer lips 33, and flap 31. Supply tray 34 is a substantially rectangular, 3-sided structure having retention lips 33 integrally formed at the corners thereof. Paper supply 32 is disposed intermediate lips 33 and a bottom flap 31, which is pivotally attached to the top of tray 34. A coil spring 19, disposed between intermediate flap 31 and tray 34, biases paper supply 32 against retaining lips 33. Supply assembly 30 is slidably mounted into a support 13 which extends between frame walls 18, so that tray 34 is preferably disposed at an acute angle $\theta$, with respect to horizontal, as shown in FIG. 7. The value of $\theta$ may be between 45° and 85°, with 60° being the preferred angle of inclination.

Referring to FIG. 4, receiving assembly 35 comprises receiving tray 36, printed stack 37, wings 38, and wing cams 39. Receiving tray 36 is secured to base 14 of housing assembly 12. Tray 36 retains stack 37 of printed sheets which are lowered therein, after printing, as explained hereinafter. Receiving tray 36 is substantially rectangular and includes a pair of side walls extending upwardly therefrom. Each side wall has an elongate slot disposed near the top thereof. A pair of U-shaped wings 38, each having a cam 39 extending therefrom, is pivotally mounted, one on each side, to the bottom of receiving tray 36. Wings 38 extend through apertures in the side walls of receiving tray 36 and may be pivotally retracted therefrom, by deflection of cam wings 39 by the pivoting platen 90.

Figure 5:
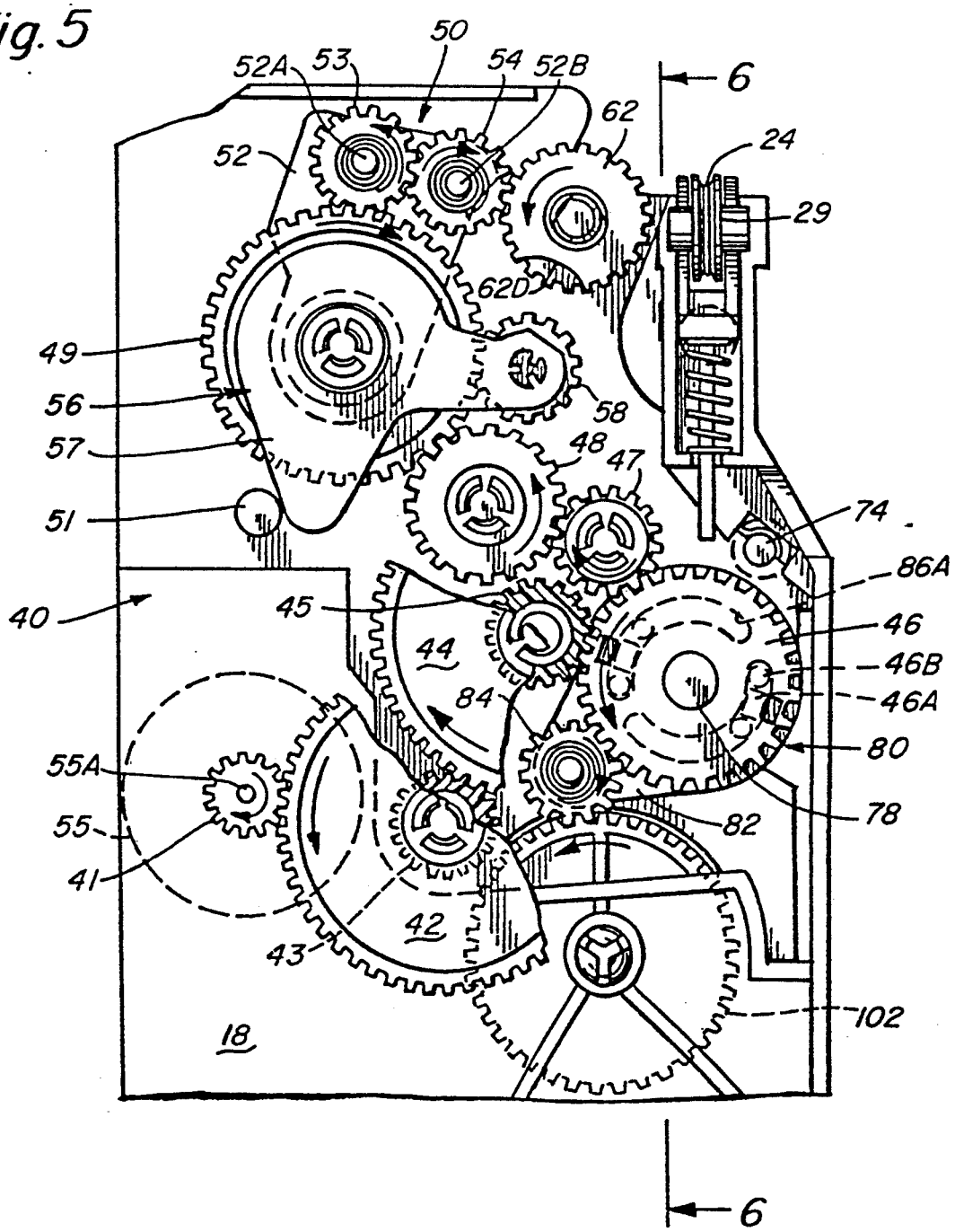
FIG. 5 is a side, partial cut-away view of the paper control and skew correction apparatus of FIG. 1 as seen along line 5—5.

Referring to FIGS. 4 and 5, transmission assembly 40 is comprised of drive motor 55 and transmission gears 41–49. Drive motor 55 may be a conventional electric motor or a stepper motor and is coupled to microprocessor 130. Microprocessor 130 is preprogrammed to control the speed and rotational direction, i.e. the angular velocity of motor 55 in a manner well known to those skilled in the art. Shaft 55A of drive motor 55 is journaled in frame 18. First transmission gear 41 is coupled to shaft 55A of motor 55, so that motor 55 and gear 41 rotate with the same angular velocity. In the preferred embodiment, gear 41 may be a spur gear having a small diameter. The teeth of gear 41 engage the teeth of gear 42 in a continuously interlocking manner so as to impart a rotational motion to gear 42 which is counter to that of gear 41.

Gear 42, in the preferred embodiment, may be a conventional spur gear having a diameter substantially larger than gear 41 so that the rotational speed of gear 42 is approximately one quarter of that of gear 41 when driven thereby. The hub of gear 42 extends perpendicular from the interior surface thereof so as to form gear 43 which is axially aligned with gear 42. Gear 43 has a smaller diameter than gear 42, as shown in FIG. 4. Gears 42 and 43 are rotatably mounted about a cylindrical projection (not shown) extending from frame wall 18 and are retained thereabout by a conventional retainer clip. The teeth of gear 43 engage the teeth of gear 44 in an interlocking manner so as to impart a counter angular velocity thereto.

Gear 44 is similar in shape and size to gear 42 and has a gear 45, similar to gear 43, axially aligned therewith. The diameter of gear 43 is sized so that when gear 43 drives gear 44, it imparts to gear 44 a rotational speed which is approximately one quarter of that of gear 43. Gears 44 and 45 are mounted onto frame wall 18 in a manner similar to gears 42 and 43, respectively. The teeth of gear 45 engage the teeth of gear 46 in an interlocking manner so as to impart a counter angular velocity thereto.

Gear 46 is preferably a conventional spur gear which is rotatably mounted about the axle 78 of roller assembly 70 and is rotatably coupled with third arm assembly 80, as explained hereinafter. Gear 46 is sized to have approximately one half of the rotational speed of gear 45 when driven by gear 45. The teeth of gear 46 engage the teeth of gear 47 in an interlocking manner so as to impart counter angular velocity thereto.

Gear 47 is preferably a conventional spur gear and is rotatably mounted onto frame wall 18 in a manner similar to gear 42. Gear 47 is sized to have approximately twice the rotational speed of gear 46 when driven by gear 46. The teeth of gear 47 engage the teeth of gear 48 in an interlocking manner so as to impart a counter angular velocity thereto.

Gear 48 is preferably a conventional spur gear and is rotatably mounted onto frame wall 18 in a manner similar to gear 42. Gear 48 is sized to have approximately 1.5 times the rotational speed of gear 47 when driven gear 47. The teeth of gear 48 engage the teeth of gear 49 in an interlocking manner so as to impart rotational motion of a counter direction thereto.

Gear 49 is preferably a conventional spur gear which is disposed intermediate first arm assembly 50 and second arm assembly 56, as explained hereinafter. Gear 49 is mounted onto frame wall 18 in a manner similar to that of gear 42. Gear 49 is sized to have approximately two thirds of the angular velocity of gear 48 when driven thereby.

Figure 6:
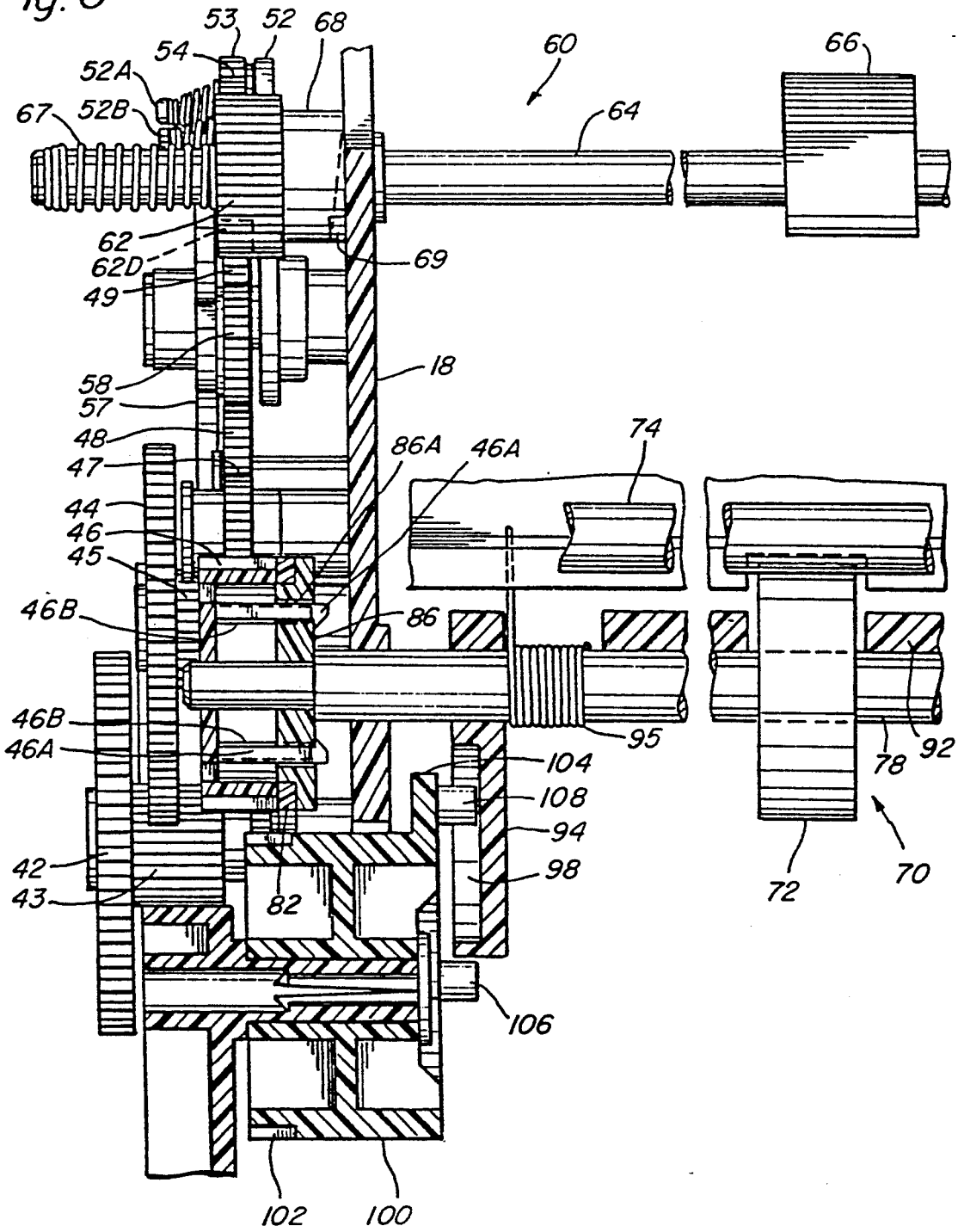
FIG. 6 is a front, cross-sectional view of the paper control and skew correction apparatus of FIG. 5, as seen along line 6—6.

Gears 41–49 are arranged as shown in FIGS. 4–6 so that gears 41, 44, 45, 47 and 49 have the same angular direction of rotation as drive motor 55, while gears 42, 43, 46 and 48 have an angular direction of rotation which is counter to that of drive motor 55. In the preferred embodiment transmission gears 41–49 are comprised of a rigid material, such as plastic, and all have teeth with uniform shape, size and pressure angles.

First arm assembly 50 comprises first arm 52, and gears 53 and 54. As indicated in FIG. 5, first arm 52 has an irregular shape (partially shown in phantom) with an aperture disposed at one end thereof for rotatable mounting to the frame wall 18 so as to be axially aligned with gear 49. At a second end of arm 52, two projections 52A–B extend perpendicularly from the exterior surface thereof. Spur gear 53 and 54 are rotatably mounted, one each, about the projections. Each of gears 52 and 53 is disposed intermediate a fiber washer (not shown) placed adjacent arm 52 and a spring secured to the respective projection, to create friction between the gear and arm 52, enabling arm 52 to pivot when necessary, as explained hereinafter.

The teeth of gear 49 engage the teeth of gear 53 for selective rotation thereof. First arm assembly 50 may pivot continuously over a range of approximately 120° from arm stop 51, which projects outward from frame wall 18, to pick gear 62 of pick assembly 60, as shown in FIG. 4. When first arm assembly 50 is disposed intermediate stop 51 or pick gear 62, the fiber washer intermediate gears 53 and 54 and arm 52 creates enough friction so that the teeth of gear 53 and gear 49 are fastly interlocked. The angular momentum imparted from gear 48 to gear 49 will not be manifested by rotation of gear 53 but by a rotation of gear 49 and first arm 52 in unison about the axis of rotation of gear 49. If arm 52 is in contact with arm stop 51 or gear 54 is engaged with pick gear 62, a rotation of gear 48 drives gear 49 which, in turn, drives gear 53 which, in turn, drives gear 54, with gears 48 and 53 rotating the same direction. Gear 54 will continue to drive pick gear 62 until the direction of gear 49 changes, as explained hereinafter.

Second arm assembly 56 is comprised of second arm 57 and gear 58, as shown in FIG. 5. Second arm 57 has an irregular L-type shape and is rotatably mounted to frame wall 18 about the axis of rotation of gear 49 on the side of gear 49 opposite first arm assembly 50. Second arm assembly 56 has a leg from which a projection (not shown) extends inwardly towards frame wall 18. Gear 58 is secured about this projection intermediate a fiber washer and spring in a manner similar to gears 53 and 54. Arm 57 selectively rotates between stop 51 and pick gear 62. While first arm assembly 50 pivots about the axis of rotation of gear 49, second arm assembly 56 also pivots about the same axis of rotation in the same direction until the leg of arm 57 encounters stop 51 or gear 58 engages pick gear 62. Upon engaging pick gear 62, gear 49 drives gear 58 which, in turn, drives gear 62 until the dish out section 62D is encountered, at which point gear 58 will continue to rotate, but with no effect on pick gear 62. The rotational motion of gears 48 and 49 causes first arm assembly 50 and second arm assembly 56 to alternately and selectively engage pick assembly 60. Since there are two gears, gears 53–54, on arm 52 and only one gear, gear 58, on arm 57 and since gears 53, 54, and 58 are driven by gear 49, the pick gear 62 will always be driven counter clockwise irregardless of the rotational direction of gear 49.

Pick assembly 60 is comprised of pick gear 62, pick shaft 64, D-shaped rollers 66, shoulder 68 and pick cam 69, as shown in FIGS. 4 and 6. Pick shaft 64 is preferably a substantially cylindrical, metal rod having a flat side, creating a D-shaped cross sectional profile. Pick shaft 64 is journaled at its end regions in frame walls 18 so as to be freely rotatable. D-shaped rollers 66 are disposed about pick shaft 64 and are positioned symmetrically about the center of top sheet 32A. D-shaped rollers 66 have a substantially D-shaped cross sectional profile and are preferably comprised of rubber or some other resilient material. The least arcuate surface of rollers 66 is corrugated to facilitate frictional engagement of a sheet of paper, as explained hereinafter. However it will be obvious to those skilled in the art that non-corrugated pick rollers may be used if their friction coefficient is sufficiently high.

Pick gear 62 is slidably mounted about the distal end of pick shaft 64, i.e. the end closest to assemblies 40 and 50. Pick gear 62 preferably is a spur gear with an arcuate-shaped dish-out section 62D along a portion of its circumference, as shown in FIG. 4. The dish-out section 62D is adapted to receive either gears 54 or 58 in a nonengaging manner. Pick gear 62 has a smooth, recessed shoulder 68 disposed on its interior surface and extending over approximately one half its circumference. The distal end of pick shaft 64 has a coiled compression spring 67 captured between an annular ridge and pick gear 62 to bias pick gear 62 against frame wall 18. Frame wall 18 includes a semi-circular inclined camming surface, pick cam 69, against which shoulder 68 is urged by spring 67. The selective deflection of shoulder 68 over pick cam 69 as pick gear 62 rotates causes axial displacement of gear 62. The axial displacement of gear 62 further causes depression of the tension spring. As pick gear 68 rotates counterclockwise, shoulder 68 disengages pick cam 69 and is urged against frame wall 18 by spring 67. As such gear 62 is disposed in a "home" position in which pick gear 62 and pick shaft 64 will not rotate further unless driven by gear 54, causing shoulder 68 to reengage pick cam 69. When gear 62 is in the "home" position gear 58 is in line with the dish-out section 62D of gear 62 and, therefore, cannot engage or turn gear 62.

Referring to FIGS. 4 and 6 roller assembly 70 is comprised of drive rollers 72, pinch roller 74, biasing springs 76, and drive roller axle 78. Drive roller axle 78 is preferably a cylindrical metal rod, having its ends rotably journaled in frame walls 18. Drive rollers 72 are coaxially disposed about drive roller axle 78 and symmetrically positioned about the center of top sheet 32A. Drive rollers 72 have a substantially annular shape and preferably have a smooth exterior surface made of a resilient material, such as rubber, which will frictionally engage either a sheet of paper or pinch roller 74, if no paper is present.

Pinch roller 74 is preferably a cylindrical rod, having a smooth surface. Pinch roller 74 is journaled at each end to frame walls 18. A biasing spring 76 is disposed about each end of pinch roller 74 and is secured to a projection of the respective frame walls 18 to bias pinch roller 74 against drive rollers 72, creating a nip therebetween. The distal end of drive roller axle 78 extends through third arm assembly 80 and gear 46 of transmission assembly 40, as explained hereinafter.

Third arm assembly 80 comprises third arm 82, gear 84, and lost motion disk 86. Referring to FIGS. 4–6, drive roller axle 78 has a shoulder (not shown) formed at the distal end thereof. Lost motion disk 86 is a circular disk having a ridge (not shown) formed along the perimeter of the exterior surface thereof. A circular aperture (not shown) is formed at the center of lost motion disk 86 to receive the distal end of drive roller axle 78. Lost motion disk 86 is press fit about the distal end of drive roller axle 78. Lost motion disk further has two semi-circular elongated slots 86A, symetrically disposed about the circular aperature therein.

Third arm 82 has an irregular shape with an aperture disposed at one end thereof. Third arm 82 is rotatably mounted about the ridge of lost motion disk 86. A projection extends outwardly from arm 82 for receiving gear 84 which is rotatably mounted thereon. As shown in FIGS. 5 and 6, a pair of hooked arms 46A, extending perpendicularly from the interior surface of gear 46, are inserted through slots 86A, respectively, of lost motion disk 86. Each hooked arm is flanked by a pair of cylindrical pins 46B which also extends from the interior of gear 46 toward lost motion disk 86. Hooked arms 46A extend through lost motion disk 86 securing it and third arm 82 against gear 46. The pins 46B are free to rotate in either direction within the elongated slots of lost motion disk 86, depending on the angular direction of gear 46. Gear 46 engages gear 84 so as to impart a counter angular velocity thereto. Gear 84, in turn, selectively engages platen gear 102, depending on the position of arm 82, so as to impart a counter angular velocity to gear 102, as explained hereinafter.

Platen assembly 90 comprises platen 92, two-stage cam 94, first cam groove 96, second cam groove 98, platen driver 100, platen gear 102, arm 104, first cam follower 106, second cam follower 108, fingers 93, platen tabs 97 and platen spring 95. As shown in FIGS. 4, and 7, platen 92 is substantially L-shaped with a flat top surface over which each sheet passes during printing. Platen 92 is pivotally mounted about drive roller axle 78 to allow pivoting thereabout. A platen spring 95 is disposed at each end of drive roller axle 78. Springs 95 are tensionally coupled to the underside of support 13 and platen 92, for biasing platen 92 counter clockwise against stops 17 into a horizontal position. The distal end of platen 92, closest to transmission assembly 40, has an irregular shaped two-stage cam 94 integrally formed therewith. A first curved elongated slot, first cam groove 96, is formed within cam 94. A curved cavity, second cam groove 98, is further integrally formed at an edge of cam 94. Platen 92 is continuously rotatable through approximately a 90° angular displacement. A pair of tabs 97 project from the front of platen 92 which, when platen 92 is rotated to a vertical position, engage wing cams 39 of receiving assembly 35 for pivoting of wings 38, as explained hereinafter.

Platen driver 100 has a generally cylindrical shape and has platen gear 102 integrally formed along its exterior perimeter and an irregularly shaped arm 104 projecting radially from its interior perimeter. First cam follower 106 and second cam follower 108, in the form of cylindrical projections, extend perpendicularly from arm 104 and selectively engage first cam grooves 96 and second cam grooves 98, respectively. The positions of the cam followers within their respective cam grooves is dependent on the position of platen driver 100 and the angle of platen 92. FIG. 7 illustrates, in phantom, the position of platen driver 100 and platen 92, when the platen is nearing its 45° position. Platen driver 100 is pivotally mounted to frame wall 18 so as to allow rotation thereof about the axis of rotation of platen gear 102. The counter angular velocity imparted from gear 84 to gear 102 causes gear 102 and arm 104 to rotate in unison. The rotation of arm 104, in turn, causes cam followers 106 and 108 to selectively engage first cam groove 96 and second cam groove 98, respectively, causing pivoting of platen 92, as explained hereinafter.

Figure 7A:
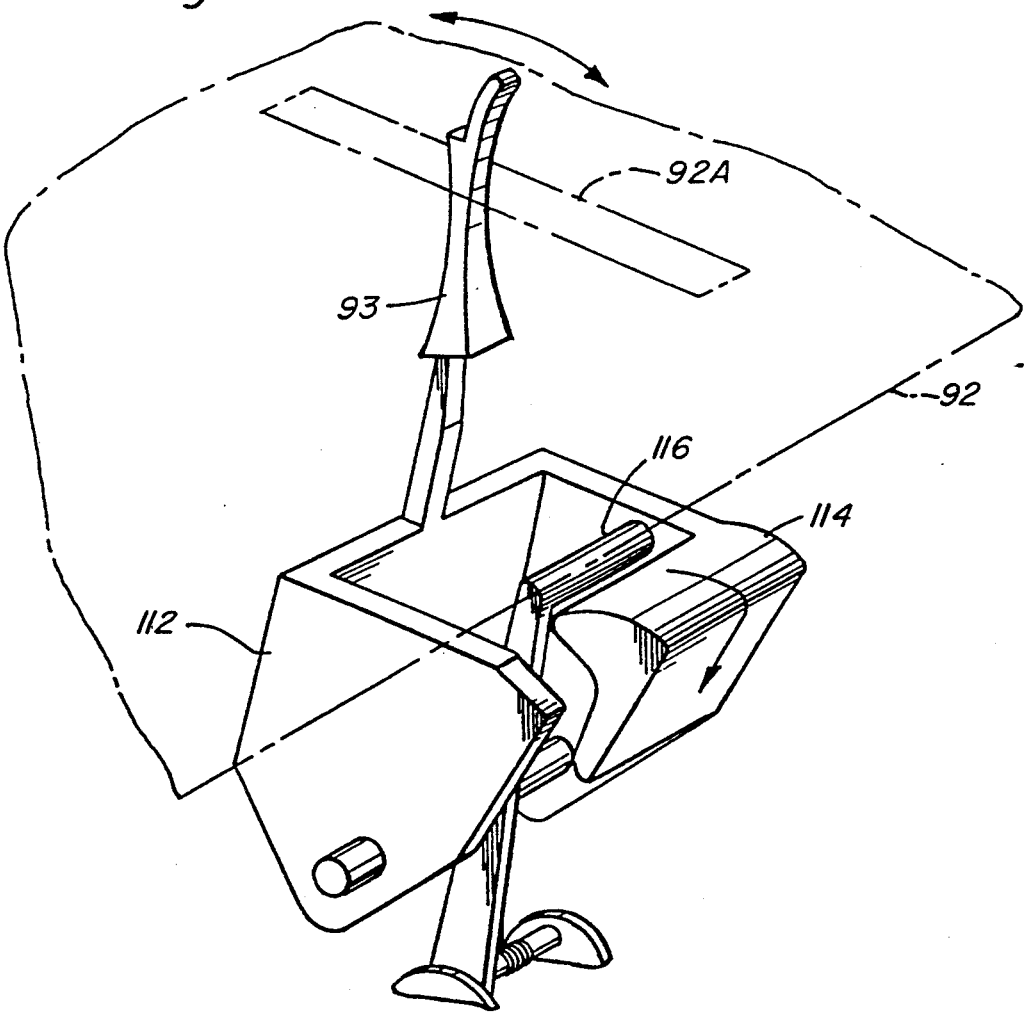
FIG. 7A is an enlarged partial perspective view of the kicker mechanism of the present invention.

Referring to FIG. 7A, one of a pair of resilient, preferably rubber, finger-like projections, kickers 93, is shown projecting through a slot 92A formed in the top surface of platen 92. Kickers 93 are attached to a kicker frame 112 which is pivotally attached to the underside of platen 92 and spring biased to pivot in a counterclockwise direction (all directions are as shown in FIG. 7A). A cam 114 is integrally formed with kicker frame 112. A cam follower 116 is pivotally attached to the base of receiving tray 36 and spring biased in a counterclockwise direction. As platen 92 pivots clockwise, cam follower 116 engages the interior surface of cam 114 causing kicker frame 112 to pivot clockwise and kicker 93 to selectively project through slot 92A. As platen 92 continues to pivot in a clockwise direction, the cam follower 116 leaves the top and exterior surfaces of cam 114, and the kicker 93 withdraws to the rear of slot 92A by a return spring located on the kicker frame 112. As platen 92 reaches its peak displacement, the lever cam 116 pivots in a clockwise direction to allow for further pivoting of platen 92 thereover. Kicker 93 assists in urging the trailing edge of top sheet 32A from platen 92 and into receiving tray 36 once the printing process is complete, as explained hereinafter. The operation of kickers 93 and particularly the interaction of platen 92 with the lever cam 116 and cam follower 114 is within the scope of understanding of those skilled in the art, and will not be explained in further detail hereinafter.

The operation of the preferred single drive motor feature of this invention which implements the skew correction method will now be described with reference to FIGS. 1–14. The terms clockwise and counterclockwise are intended to have a conventional meaning as shown when looking from the left edges of FIGS. 1–14, except FIGS. 2, 5, 6, 7. Referring to FIG. 4, printer 10 and particularly apparatus 15 is shown in a pause mode, following the printing of a sheet of paper, in which assemblies 40, 50, 56, 60, 70, 80 and 90 are in a temporarily inactive state. As indicated in FIG. 4, first arm assembly 50 is disposed in a substantially vertical position so that gear 54 nearly engages pick gear 62. Pick assembly 60 is disposed in its "home" position so that shoulder 68 is biased adjacent frame wall 18 by spring 67. In the home position, the corrugated surfaces of D-shaped rollers 66, face outwardly away from supply tray 34 and paper supply 32. Second arm assembly 56, is positioned so that arm 57 is resting against stop 51, with gear 58 disengaged from pick gear 62. As shown in FIG. 7, arm 104 of platen driver 100 is positioned so that second cam follower 108 engages second cam groove 98, causing platen 92 to pivot about drive roller axle 78. During the pause mode, platen 92 is disposed approximately 60° horizontal, so that tabs 97 deflect the cam wings 39 of receiving assembly 35 causing wings 38 to withdraw from the apertures in the side walls of receiving tray 36. The pause mode is assumed by paper control apparatus 15 following the lowering of the most recently printed sheet into receiving tray 36 by wings 38, hence the retracted position of the wings.

Figure 8:
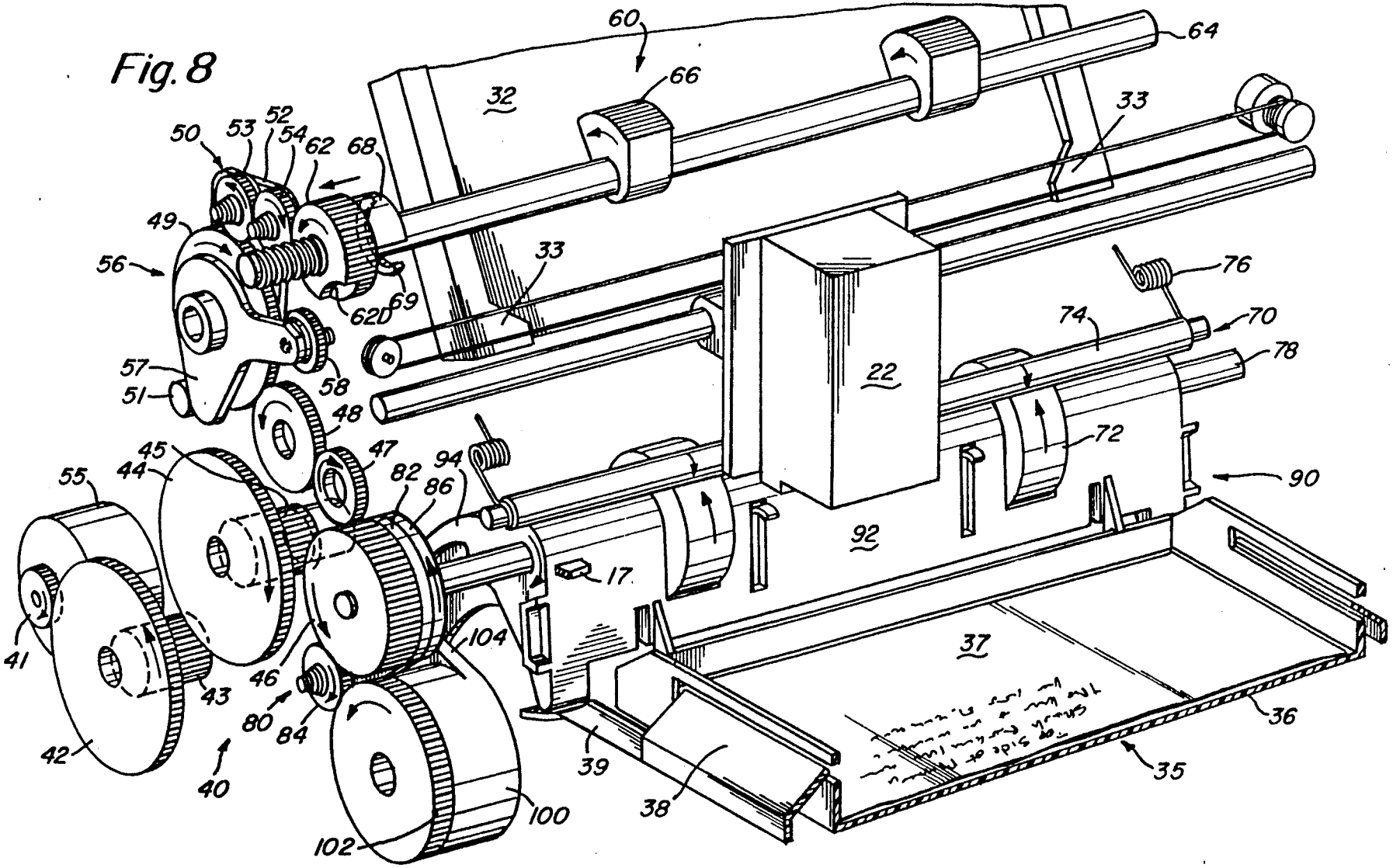
FIGS. 8–12 are sequential perspective views of FIG. 4 illustrating chronologically the positions of the components of the paper control and skew correction apparatus during the skew correction mode.

FIG. 8 illustrates the positions of assumed by the various assemblies in paper control apparatus 15 during the initial phases of the pick process. The terms clockwise and counterclockwise are used with reference to FIG. 8. The feed of a top sheet 32A from paper supply 32 is initiated from the pause mode by drive motor 55 rotating under microprocessor control in the clockwise direction. The rotation of drive motor 55 causes transmission gears 44, 45, 47, and 49 to likewise rotate clockwise direction, at various lesser angular velocities, while gears 42, 43, 46 and 48 rotate in a counterclockwise direction, with various lesser angular velocities, as indicated by the arrows in FIG. 8.

Transmission gear 49 applies torque to arm 52 which rotates arm 52 clockwise until gear 54 engages pick, gear 62. Transmission gear 49 drives gear 53 of first arm assembly 50 which, in turn, drives gear 54. Gear 54 engages pick gear 62 rotating in counterclockwise direction so that shoulder 68 slides over pick cam 69 causing pick gear 62 to slide axially along pick shaft 64. Pick shaft 64 and D-shaped rollers 66 also rotate counterclockwise towards supply tray 34 and paper supply 32.

The counterclockwise rotation of gear 46 causes lost motion disk 86, drive roller axle 78 and drive roller 72 to likewise rotate in counterclockwise direction. Pinch roller 74 is rotated by drive roller 72 in a clockwise direction, as indicated. Gear 46 further drives gear 84 of third arm assembly 80, which in turn, drives gear 102 of platen driver 100 in a counterclockwise direction. The motion of gear 102 causes arm 104 and specifically, second cam follower 108 to move further in the second cam groove 98. At this point, platen 92 is disposed at its peak angle, approximately 85° from the horizontal. As platen 92 reaches its peak angle, fingers 93 are disposed at the rear of the slots formed in platen 92.

Figure 9:
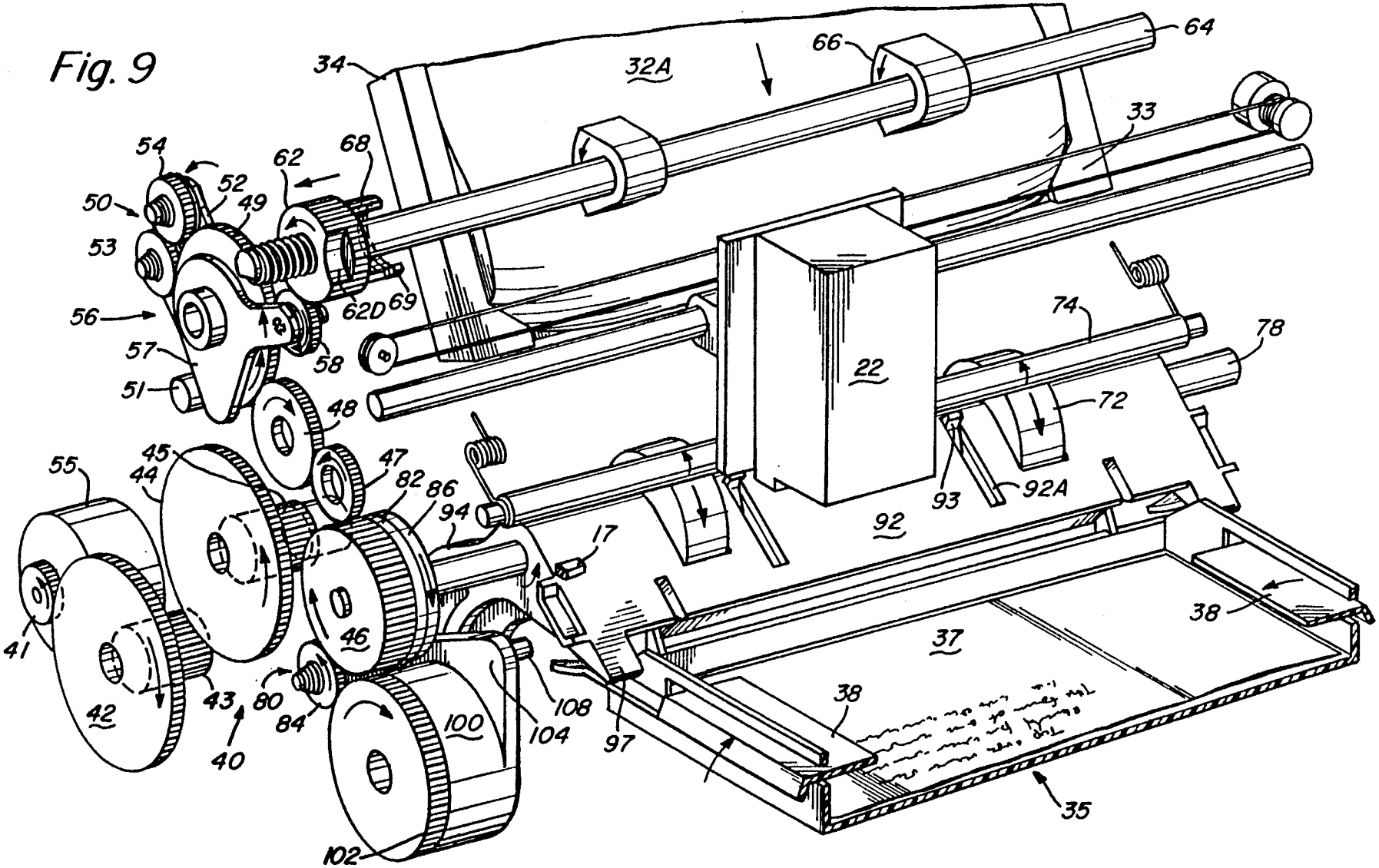

Referring to FIG. 9, drive motor 55 reverses directions, now rotating in a counterclockwise direction (all directions are as shown in FIG. 9). The motion of drive motor 55 is translated through gears 41–47 to gear 48. Gear 48 drives gear 49, causing gear 49, first arm assembly 50 and second arm assembly 56 to rotate in a counterclockwise direction about the axis of rotation of gear 49. The counterclockwise rotation of arm 52 causes gear 54 to disengage pick gear 62 while causing gear 58 to engage pick gear 62. Upon engaging pick gear 62, gear 58 is driven in a clockwise direction by gear 49. Gear 58, in turn, drives pick gear 62 in a counterclockwise direction, causing shoulder 68, which is integrally formed therewith, to be deflected by pick cam 69. Pick gear 62 rotates, pick roller 64 and D-shaped rollers 66 in a counterclockwise direction. As D-shaped rollers 66 rotate, their corregated surfaces frictionally engage the top sheet 32A of paper supply 32, forcing it against retainer lips 33 of supply tray 34. As D-shaped rollers 66 continue their counterclockwise motion, top sheet 32A buckles forcing its leading edge away from supply tray 34, releasing top sheet 32A from lips 33, as indicated in FIG. 9.

Gear 46 rotates clockwise direction, causing lost motion disk 86, drive roller axle 78 and drive rollers 72 to rotate in a clockwise direction. Gear 46 drives gear 84 of third arm assembly 80 causing platen gear 102 and arm 104 of platen driver 100 to also rotate in a clockwise direction. The rotation of arm 104 causes first cam follower 106 to enter first cam groove 96 and causes second cam follower 108 to leave second cam groove 98, pivoting platen 92 about drive roller axle 78 in a counterclockwise direction. As platen 92 pivots towards a horizontal orientation, tabs 97 disengage cam wings 39 causing wings 38 to return to their initial position, extending through the side walls of receiving tray 36.

Figure 10:
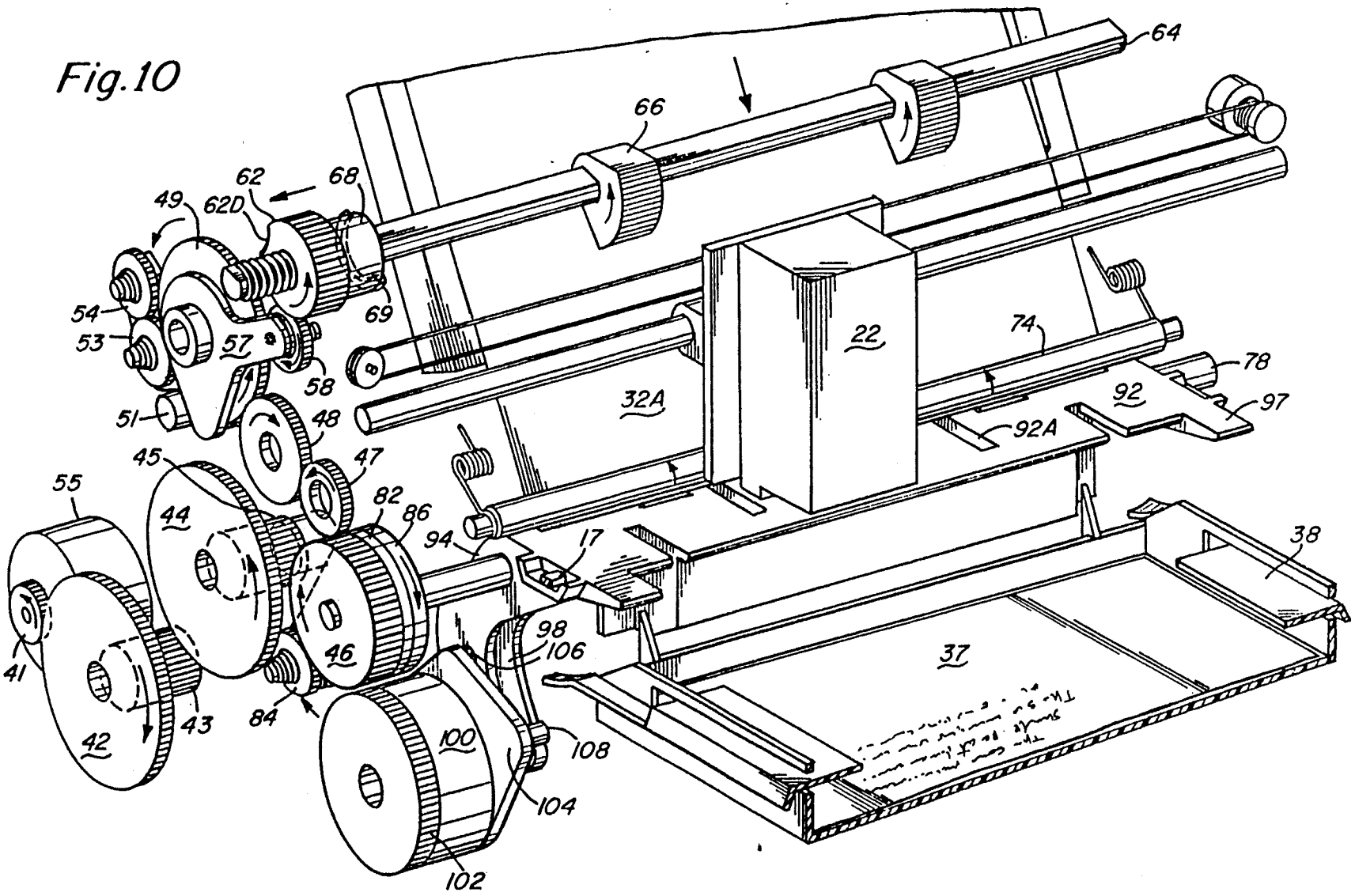

Referring to FIG. 10, drive motor 55 continues rotating in a counterclockwise direction (all directions are as shown in FIG. 10). Gear 48 continues to rotate in a clockwise direction, driving gear 49 in a counterclockwise direction and causing first arm assembly 50 to pivot in a counterclockwise direction until encountering stop 51 of frame wall 18. Gear 58 of second arm assembly 56 continues to drive pick gear 62 in a counterclockwise direction, causing shoulder 68 to be further deflected by pick cam 69. The deflection of shoulder 68 causes further axial displacement of pick gear 62 along pick roller 64. As pick gear 62 rotates in counterclockwise direction, D-shaped rollers 66 also rotate in a counterclockwise direction urging top sheet 32A out of supply tray 34 and into the nip formed between drive rollers 72 and pinch roller 74.

Gear 46, lost motion disk 86, drive roller axle 78 and drive rollers 72 continue to rotate in a clockwise direction, while pinch roller 74 rotates in a counterclockwise direction. As D-shaped rollers 66 advance sheet 32A, its leading edge is engaged by drive rollers 72 and pinch roller 74. The motion of rollers 72 and 74 advance the leading edge of sheet 32A preferably approximately seven millimeters beyond the nip line 75.

As platen 92 is pivoted towards a horizontal position, it encounters platen stop 17, which is integrally formed with frame wall 18, at which point platen 92 is generally horizontal in orientation, as shown in FIG. 10. The force exerted by the platen springs 95 is transferred by cam followers 106 and 108 and gear 102 to gear 84, causing gears 84 and 102 to remain engaged until platen 90 reaches stop 17, at which time the force from platen springs 95 is no longer transferred. Platen 92 returns to horizontal smoothly as gear 46 rotates clockwise. Third arm 82 also pivots clockwise so that gear 84 disengages platen gear 102. Third arm 82 pivots until hitting a stop (not shown) integrally formed with frame wall 18.

Figure 11:
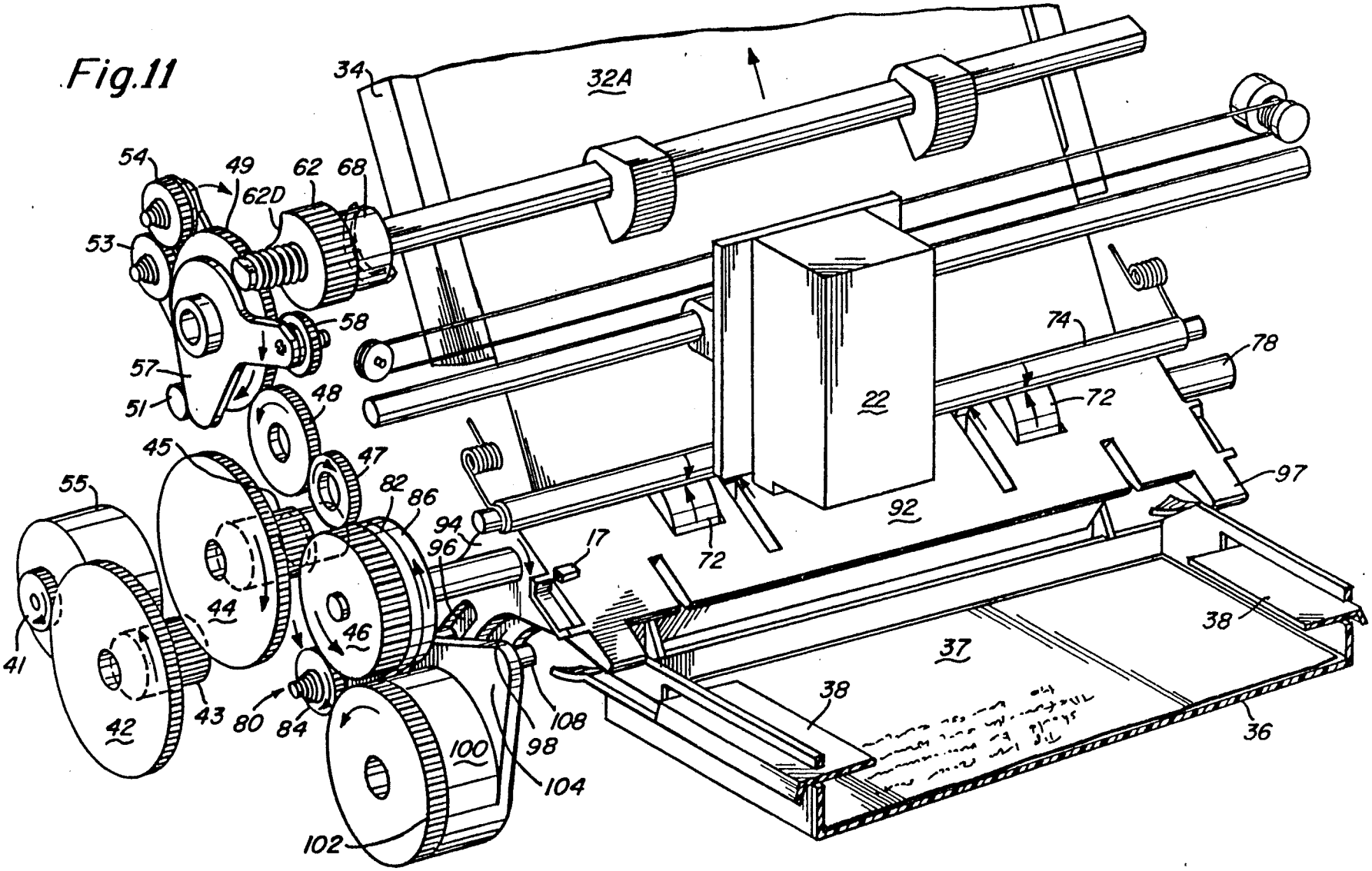

In accordance with the method of skew correction of the present invention, once a sheet of paper is advanced through the drive roller assembly, it is retracted so as to be disposed within the nip. Referring to FIG. 11, drive motor 55 reverses direction, now moving clockwise (all directions are as shown in FIG. 11). This motion is translated through gears 41–47, causing gear 48 to rotate in a counterclockwise direction, and drive gear 49 to rotate in a clockwise direction. The teeth of gear 53 are fixed within the teeth of gear 49 causing arm 52 of arm assembly 50 to pivot in a clockwise direction about the axis of rotation of gear 49. The clockwise rotation of gear 49 causes arm 57 to pivot in a clockwise direction until encountering stop 51. As arm 57 pivots gear 58 disengages pick gear 62. The disengagement of pick gear 62 causes pick roller 64 and D-shaped rollers 66 to remain stationary, with the corrugated surfaces of rollers 66 facing away from paper supply 32.

The clockwise motion of drive motor 55 is translated through gears 41–46 to gear 84, which in turn drives gear 102, arm 104 in a counterclockwise direction. As arm 104 pivots in a counterclockwise direction, first cam follower 106 begins to withdraw from first cam groove 96 while second cam follower 108 begins to engage second cam groove 98. The interaction of the first and second cam followers with the two-stage cam 94 causes platen 92 to pivot in a clockwise direction continuously.

When platen 92 is disposed at approximately 25° with respect to horizontal, the pins 46B protruding from gear 46 into the elongated slots 86A of lost motion disk 86 engage the disk, rotating it in a counterclockwise direction. The rotation of lost motion disk 86 causes drive roller axle 78 and drive rollers 72 to rotate in a counterclockwise direction, which in turn cause pinch roller 74 to rotate in a clockwise direction. The combined motions of pinch roller 74 and drive rollers 72 cause top sheet 32A to move backward and upward through nip 75 and disengage rollers 72 and 74. Once the entire leading edge of top sheet 32A is free of pinch roller 74, the force of gravity on the mass of the sheet, i.e. its weight, forces the leading edge of sheet 32A to remain in the nip, as shown in FIG. 2. If sheet 32A had been initially skewed upon entering the nip in a forward direction, as soon as it is reversed through the nip, the angle of the sheet, in conjunction with its weight force the leading edge to settle into the nip so that it is parallel thereto as shown in FIG. 3.

Figure 12:
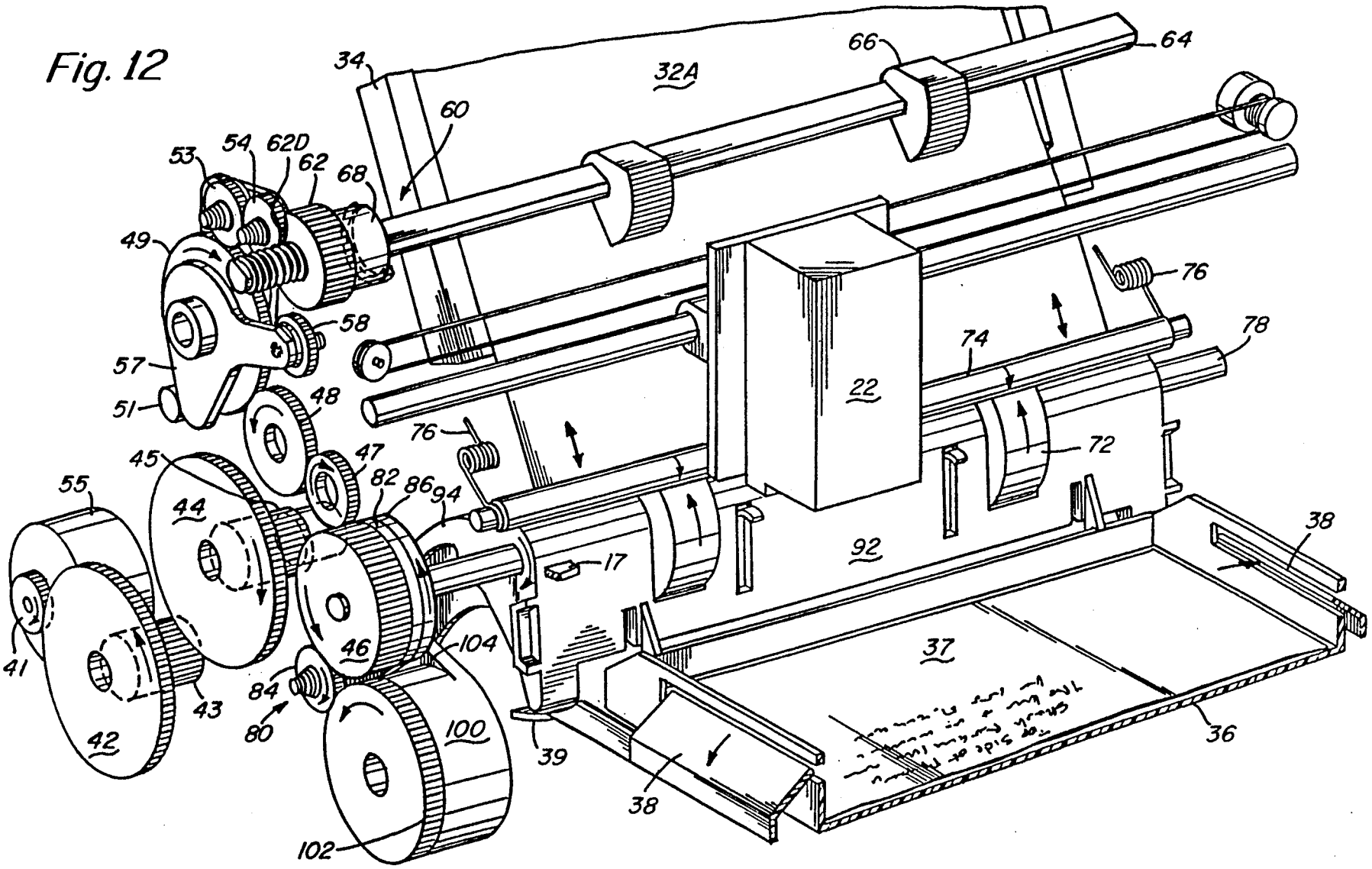

With the leading edge of top sheet 32A is situated within nip 75, as shown in FIG. 2, drive motor 55 continues to rotate in a clockwise direction (all directions are as shown in FIG. 12). Gear 46, lost motion disk 86, drive roller axle 78 and drive rollers 72 continue to rotate in a counterclockwise direction, while pinch roller 74 continues to rotate in a clockwise direction. This "backwards running" of rollers 72 and 74 allow top sheet 32A to jiggle out of nip 75 or do a "gravity dance", allowing the leading edge of sheet 32A to overcome the frictional engagement of rollers 72 and 74 and to settle parallel into nip 72 solely because of the force of its own weight. Drive rollers 72 and pinch roller 74 are rotated in reverse for a short period of time, for example one second, to provide the minimum time necessary for the leading edge of top sheet 32A to settle parallel to nip 75. It will be obvious to those reasonably skilled in the art that the duration of the "gravity dance" or the length of time in which the rollers are run in reverse should be long enough to guarantee that the leading edge of top sheet 32A is completely released from rollers 72 and 74, regardless of the amount of skew and the extent to which the leading edge was advanced beyond the nip. During this gravity dance it is important that sheet 32A be free of any side forces which may discourage it from settling parallel with nip 75.

Following the gravity dance, top sheet 32A, assumes the position indicated by the solid lines in FIG. 3, in which its leading edge is shown substantially parallel with nip 75 formed between drive roller 72 and pinch roller 74. With the leading edge of top sheet 32A now parallel with nip 75, the sheet may again be advanced through the nip and into the printing zone. To align the print heads 22A of printing assembly 20 with the same location on each sheet of paper, thereby insuring a uniform top margin or "top-of-form", the paper control apparatus 15 need only advance the leading edge of top sheet 32A a predetermined distance into the print zone. This distance may be programmed into microprocessor 130 according to the printing format desired. Accordingly, the need for special detecting switches, used in prior art printers to locate the leading edge for "top-of-form" alignment is eliminated.

Figure 13:
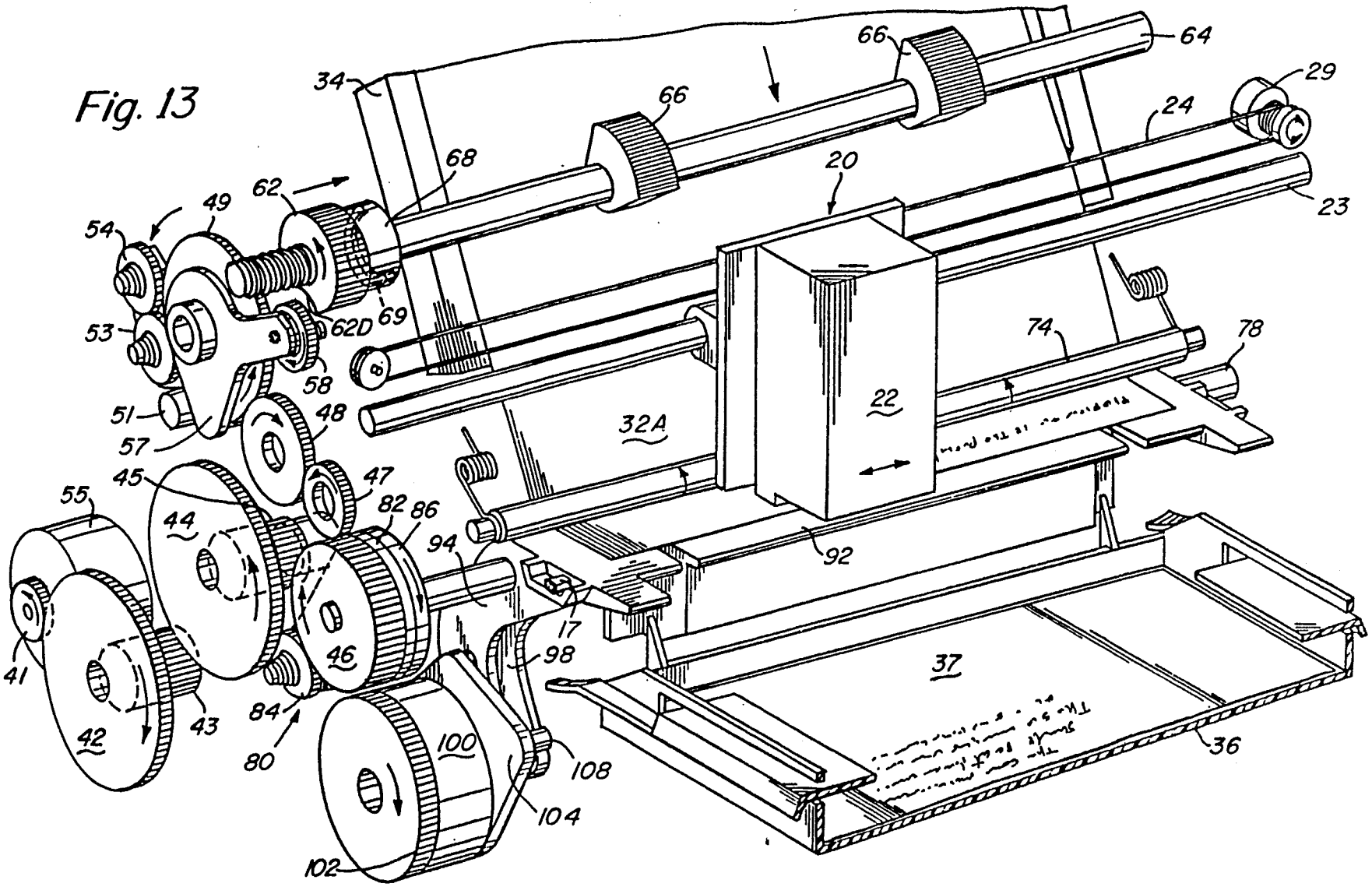
FIGS. 13–14 are sequential perspective views of FIG. 4 illustrating chronologically the positions of the components of the paper control and skew correction apparatus during the print mode.

Referring to FIG. 13, drive motor 55 reverses directions, now rotating in a counterclockwise direction (all directions are as shown in FIG. 13). The rotation of drive motor 55 is translated to first arm assembly 50 and second arm assembly 56, through transmission gears 41–49, causing both arm assemblies to rotate in a counterclockwise direction. Gear 49 drives gear 58 in a clockwise direction, which in turn, drives pick gear 62 and pick assembly 60 in a counterclockwise direction. Pick cam 69 continues to deflect shoulder 68 and pick gear 62 axially along pick roller 64 until the teeth of gear 58 are adjacent dish out section 62D of gear 62. At this point, shoulder 68 slides off pick cam 69 under the force of the spring 67 and is disposed adjacent frame wall 18. With the sliding movement of pick gear 62 against frame wall 18, the teeth of gear 58 disengage pick gear 62 and slide into dish out section 62D of pick gear 62. Pick gear 62 is now in the "home" position in which pick roller 64 is stationary and gear 58 is effectively disengaged, with further rotation thereof not effecting pick gear 62.

The counterclockwise rotation of drive motor 55 is translated through gears 41–46 to gear 84 which is rotated in a counterclockwise direction. Gear 84 in turn allows the platen gear 102 to rotate in a clockwise direction. Arm 104 rotates in unison with platen gear 102 so that first cam follower 106 enters first cam groove 96 while second cam follower 108 exits from second cam groove 98. The interaction of the first and second cam followers with the first and second cam grooves, respectively causes a pivoting of two-stage cam 94 and platen 92 in a counterclockwise direction, toward a horizontal position. When platen 92 is disposed at approximately a 15° with respect to horizontal (not shown), the cylindrical pins of gear 46 engage lost motion disk 86, driving disk 86 in a clockwise direction. The rotation of disk 86, in turn, causes a rotation of drive roller axle 78 and drive rollers 72 in a clockwise direction. The clockwise rotation of rollers 72 cause a counterclockwise rotation of pinch roller 74. The combined action of roller 72 and 74 on the leading edge of top sheet 32A advances the sheet beyond the nip through the rollers, and toward the print zone.

As drive motor 55 continues to rotate in a counterclockwise direction, platen driver 100 continues to pivot platen 92 in a counterclockwise direction until it engages platen stops 17 of frame wall 18, indicating that a horizontal position has been reached. The motion of drive motor 55 continues to be translated through gears 41–48 to gear 49 which is driven in a counterclockwise direction. The motion of gear 49 causes a counterclockwise pivoting of first arm assembly 50 until it encounters stop 51 of frame wall 18. Gear 49 continues to drive gear 58 of second arm assembly 56 in a clockwise direction. The rotation of the gear 58 has no effect on pick gear 62, with pick assembly 60 remaining inactive for the remainder of the printing process.

Gear 46 continues to rotate in a clockwise direction causing lost motion disk 86, drive roller axle 78, and print rollers 72 to rotate in a clockwise direction, which causes pinch roller 74 to rotate in a counterclockwise direction. The combined action of roller 72 and 74 continues to advance the leading edge of top sheet 32A over platen 92 and into the print zone, at approximately 16 millimeters past nip 75. Once top sheet 32A has entered the print zone, printhead carriage 22 of print assembly 20, under microprocessor control, travels back and forth on carriage rod 23 through the printing zone depositing ink onto top sheet 32A. The horizontal angle of platen 92 facilitates bending of sheet 32A and maintains proper head-to-paper spacing by keeping the sheet flat as it is advanced through the print zone by the motion of drive rollers 72 and pinch roller 74, as shown in FIG. 13.

As top sheet 32A is advanced over platen 92 and through the print zone, its leading edge falls off platen 92 and onto wings 38 of receiving assembly 35. Wings 38 prevent sheet 32A from smearing the ink on the most recently printed sheet disposed in receiving tray 36. Paper control apparatus 15 maintains its current status during the printing process until the trailing edge of top sheet 32A enters the print zone.

Figure 14:
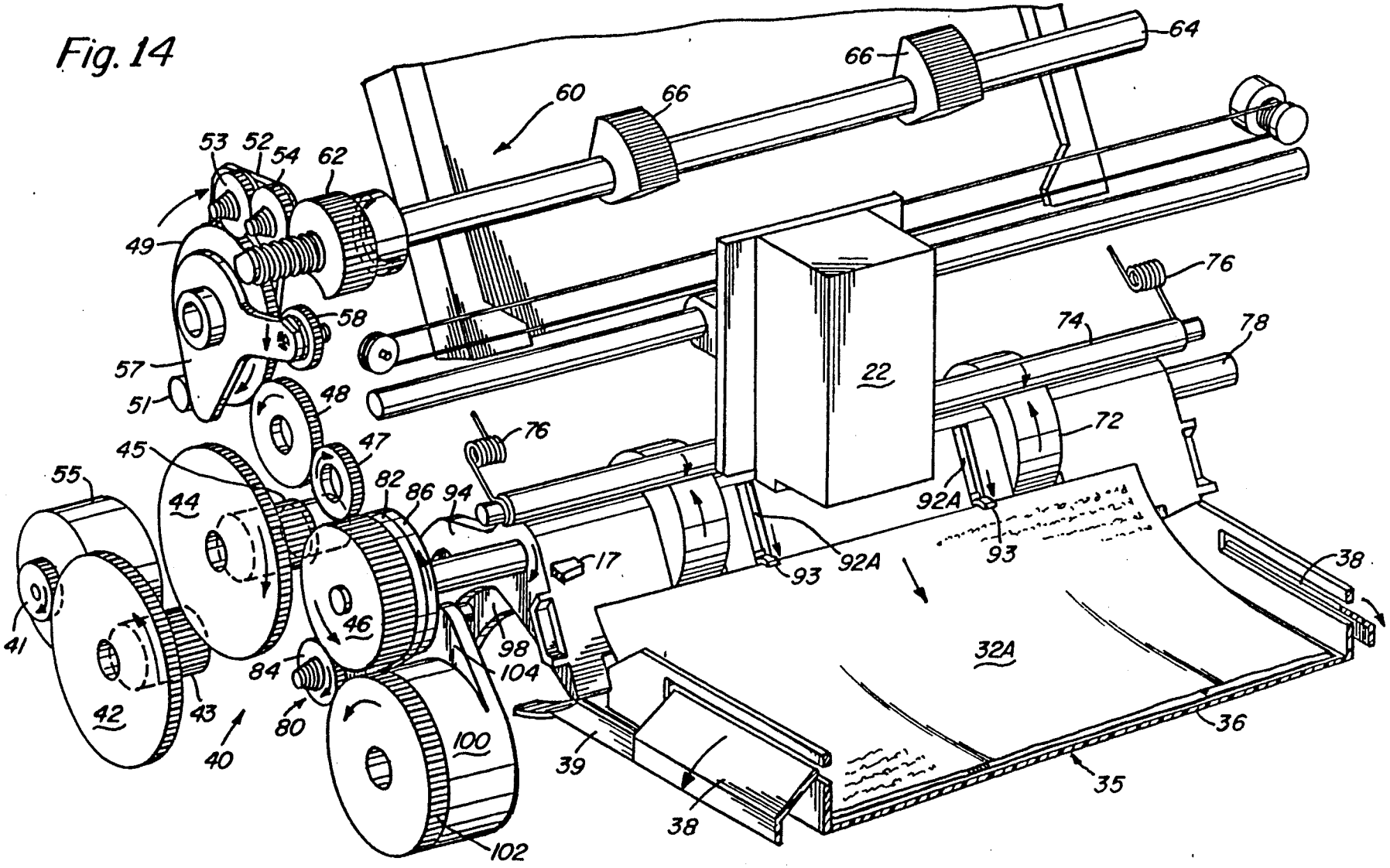

Referring to FIG. 14, drive motor 55 reverses and moves in a clockwise direction (all directions are as shown in FIG. 14). The motion of drive motor 55 is translated through gears 41–48 causing gear 49 to rotate in a clockwise direction which, in turn, causes first arm assembly 50 to pivot in a clockwise direction so that gear 54 nearly engages pick gear 62, while second arm assembly 56 pivots in a clockwise direction and encounters stop 51 of frame wall 18. The rotary motion of drive motor 55 is translated to gear 46 through gears 41–45 causing gear 46 to rotate in a counterclockwise direction. The motion of gear 46 causes lost motion disk 86, drive roller axle 78, and drive roller 72 to also rotate in a counterclockwise direction. The motion of drive roller 72 causes pinch roller 74 to rotate in a clockwise direction.

Gear 46 drives gear 84 of third arm assembly 80, which in turn drives gear 102 of platen driver 100. Arm 104 of platen driver 100 rotates in a counterclockwise direction causing cam followers 106 and 108 to engage cam grooves 96 and 98, respectively causing a pivoting of platen 92 in a clockwise direction, as indicated. Platen 92 continues to pivot about drive roller axle 78 in a clockwise direction, causing fingers 93 to project outward though slots 92A and engage the trailing edge of top sheet 32A, urging sheet 32A from platen 92 and into receiving tray 36. When platen 92 is approximately 15° above vertical, gear 46 engages lost motion disk 86, as previously described, rotating lost motion disk 86, drive roller axle 78, and drive rollers 72 in a counterclockwise direction. The motion of drive rollers 72 rotate pinch roller 74 in a clockwise direction.

As platen 92 attains a position of approximately 60° with respect to horizontal, tabs 97 deflect cam wings 39, causing wing 38 to be pivotally retracted from the side walls of receiving tray 36. As wings 38 retract, top sheet 32A falls into receiving tray 36.

The complete cycle of picking a sheet of paper, feeding it to paper control and skew correction assembly 15, correcting the skew and printing the paper is complete. Paper control apparatus 15 next returns to the state described with regard to the pause mode, as illustrated in FIG. 4, awaiting operation on the next sheet of paper.

In the method and apparatus of the present invention a single drive motor is utilized to correct the skew of a sheet of paper during the feed process and control the paper during the printing process.

In view of the above description, it is likely that modifications and improvements will occur to those skilled in the art which are within the scope of this invention. The above description is intended to be exemplary only the scope of the invention being defined by the following claims and their equivalents.

What is claimed is:

1. An apparatus for single motor control of individual sheets of paper in a printer mechanism comprising:

a roller assembly having a drive roller and a pinch roller disposed parallel with and adjacent to one another so as to form a nip therebetween;

means for supplying individual sheets of paper to the roller assembly from a supply of sheets of paper, said supplying means including a pick roller which is selectively actuable to pick a sheet of paper from said supply for transfer to said roller assembly;

a platen;

means for selectively pivoting said platen in one of two opposite directions with respect to said roller assembly;

a printing assembly for traversing said platen, and for depositing ink on a sheet of paper received from said supplying means;

means for receiving a sheet of paper from said platen and said printing assembly;

a single drive motor; and means for coupling said single drive motor to each of said roller assembly, said platen pivoting means and said supplying means said coupling means comprising:

means for controlling timing of actuation of said pick roller; and second means for controlling timing of actuation of said platen pivoting means.

2. Apparatus as recited in claim 1 further comprising a control means, coupled to the drive motor, for selectively controlling the angular direction and velocity of the drive motor.

3. Apparatus as recited in claim 2 wherein said control means comprises a programmable digital processor.

4. Apparatus as recited in claim 1 further comprising kicker means for urging a sheet of paper from said platen to said receiving means after release of a sheet of paper from said roller assembly.

5. The apparatus of claim 1 wherein said receiving means comprises:

a tray;

means for supporting a sheet of paper along edges thereof at a location spaced above said tray;

means for releasing a sheet of paper from said supporting means to fall into said tray; and means on said releasing means which are engaged by said platen for actuation of said releasing means.

6. Apparatus for control of individual sheets of paper in a printer mechanism, the sheets of paper having an edge, said apparatus comprising:

a frame;

a supply of paper;

a platen supported by and pivotally mounted with respect to said frame and having a printing surface;

means for receiving sheets of paper from said platen;

a roller assembly mounted in said frame and having rollers for engaging and advancing a sheet of paper in a forward direction from said supply of paper over said printing surface and to said receiving means;

means, moveable in the forward direction with respect to said frame, for engaging the edge of sheet of paper to urge the sheet of paper in its forward direction from said platen to said receiving means once the sheet of paper is forwardly disengaged from said rollers of said roller assembly; and means for tilting said platen in a first angular direction from a first position for printing on the paper to a second position.

7. The apparatus of claim 6 wherein said tilting means further comprises means for tilting said platen in a second angular direction, opposite of said first angular direction, from the second position to the first position.

8. The apparatus of claim 7 wherein said means for tilting said platen further comprises means for controlling the speed of movement of said platen when said platen is tilting in said second angular direction.

9. The apparatus of claim 8 wherein said platen includes an aperture in said printing surface and wherein said engaging means comprises a pivotally mounted finger which projects through said aperture when said platen is tilted in said first angular direction with respect to said first position.

10. The apparatus of claim 9 wherein said finger does not project through the aperture when said platen is in said first position.

11. The apparatus of claim 6 further comprising drive means and wherein said means for tilting said platen comprises a plurality of meshed gears coupling said drive means to said platen.

12. Apparatus for control of individual sheets of paper in a printer mechanism, the sheets of paper having an edge, said apparatus comprising:

a frame;

a supply of paper;

a platen supported by said frame and having a printing surface;

a printing assembly for recording information on a sheet of paper as it advances over the printing surface;

means for receiving sheets of paper from said platen;

a roller assembly mounted in said frame and having rollers for engaging and advancing a sheet of paper in a forward direction from said supply of paper over said printing surface and to said receiving means;

means, movable in the forward direction with respect to said frame, for engaging the edge of a sheet of paper to urge the sheet of paper in its forward direction from said platen to said receiving means once the sheet of paper is forwardly disengaged from said rollers of said roller assembly, wherein said engaging means engages an edge of a sheet of paper spaced from and not in contact with the information recorded on the sheet of paper.

13. The apparatus of claim 12 wherein said engaging means engages a trailing edge only of a sheet of paper, the trailing edge facing away from said receiving means.

14. A method of advancing a sheet of paper through a printer mechanism, the printer mechanism comprising a platen having a printing surface, a roller assembly for advancing the paper over the platen, a printing assembly for recording information on a surface on the paper on the printing surface, and an area for receiving the paper once it has been printed, the sheet of paper having an edge, the method comprising the steps of:

a. conveying the sheet of paper over the printing surface on the platen with the roller assembly;

b. recording information on the surface of the paper;

c. disengaging the sheet of paper from the roller assembly after said recording step; and d. pushing the edge of the sheet of paper toward the receiving area to urge said paper over the platen and into the receiving area after said disengaging step, said pushing step contacting only the edge and not the surface of the paper on which information was recorded in said recording step.

15. The method of claim 14 wherein step (d) further comprises tilting the printing surface of the platen in a first angular direction from a first position for printing to a second position in which the printing surface forms an angle with respect to a horizontal position sufficient to permit the paper to at least partially slide off the platen under an influence of gravity.

16. The method of claim 15 further comprising the step of:

(e) tilting the platen in a controlled manner in a second angular direction, opposite of said first angular direction, to return the printing surface to the first position.

17. A method of advancing a sheet of paper through a printer mechanism, the printer mechanism comprising a platen having a printing surface, a roller assembly for advancing the paper over the platen, a printing assembly for recording information on a surface of the paper on the printing surface, and an area for receiving the paper once it has been printed, wherein the sheet of paper has an edge facing away from the receiving area, the method comprising the steps of:

a) conveying the sheet of paper over the printing surface on the platen with the roller assembly;

b) recording information on the surface of the paper;

c) disengaging the sheet of paper from the roller assembly after said recording step; and d) pushing the edge of the sheet of paper toward the receiving area to urge said paper over the platen into the receiving area after said disengaging step, without contacting the surface of the paper on which information was recorded in said recording step and tilting the printing surface of the platen in a first angular direction from a first position for printing to a second position in which the printing surface forms an angle with respect to a horizontal position sufficient to permit the paper to at least partially slide off the platen under an influence of gravity.

18. The method of claim 17, further comprising the step of e) tilting the platen in a controlled manner in a second angular direction, opposite of said first angular direction, to return the printing surface to the first position.

19. A method for controlling individual sheets of paper in a printer mechanism having a roller assembly, a paper supply, a platen, a printing assembly, means for receiving paper after it has been printed by the printing assembly, a drive motor and means coupling the drive motor to the paper supply, the roller assembly and the platen, the method comprising the steps of:

selecting individual sheets from the paper supply;

supplying individual sheets from the paper supply to the platen using the roller assembly;

pivoting the platen into a first position to receive a sheet of paper;

printing onto the sheet of paper while the platen is in a first position;

pivoting the platen into a second position to allow a printed sheet of paper to be transferred to the receiving means; and controlling timing of said supplying step, said selecting step and both of said pivoting steps by said coupling means.

* * * * *